US007017598B2

(12) United States Patent
Nipke

(10) Patent No.: US 7,017,598 B2
(45) Date of Patent: Mar. 28, 2006

(54) POWERED PATIO POLE UMBRELLA

(75) Inventor: Mike Nipke, Grandville, MI (US)

(73) Assignee: Vendor Development Group, Grand Rapids, MI (US)

( * ) Notice: Subject to any disclaimer, the term of this patent is extended or adjusted under 35 U.S.C. 154(b) by 0 days.

(21) Appl. No.: 10/781,183

(22) Filed: Feb. 18, 2004

(65) Prior Publication Data

US 2004/0221883 A1 Nov. 11, 2004

Related U.S. Application Data

(60) Provisional application No. 60/541,526, filed on Feb. 3, 2004, provisional application No. 60/448,704, filed on Feb. 18, 2003.

(51) Int. Cl.
*A45B 3/02* (2006.01)

(52) U.S. Cl. ..... 135/16; 135/98; 135/910; 362/102; 439/638

(58) Field of Classification Search ..... 135/16, 135/28, 910, 20.3, 98, 15.1; 362/102, 123, 362/253, 431; 439/638–639, 652
See application file for complete search history.

(56) References Cited

U.S. PATENT DOCUMENTS

| | | | | |
|---|---|---|---|---|
| 2,087,537 | A | 7/1937 | Finkel | |
| D130,643 | S | 12/1941 | Hose | |
| 3,215,831 | A * | 11/1965 | Gladsden et al. | 362/431 |
| D208,917 | S | 10/1967 | Mellyn | |
| 4,061,154 | A | 12/1977 | Cox et al. | |
| 4,072,857 | A * | 2/1978 | DeVicaris | 362/123 |
| 4,174,532 | A | 11/1979 | Kelley | |
| 4,491,141 | A | 1/1985 | Eppenbach | |
| D295,400 | S | 4/1988 | Wung | |
| 4,979,535 | A | 12/1990 | Sadowski et al. | |
| 4,994,631 | A | 2/1991 | Williams, Jr. | |
| 5,053,931 | A | 10/1991 | Rushing | |
| 5,101,844 | A | 4/1992 | Morrone | |
| 5,331,524 | A | 7/1994 | Tseng | |
| 5,463,535 | A * | 10/1995 | Vest | 362/102 |
| 5,584,357 | A * | 12/1996 | Gugel et al. | 182/129 |
| 5,611,614 | A | 3/1997 | Morgan | |
| D378,913 | S | 4/1997 | Chambers et al. | |
| D379,176 | S | 5/1997 | Chambers et al. | |
| D379,970 | S | 6/1997 | Chambers et al. | |
| 5,641,223 | A | 6/1997 | Rustebakke | |
| 5,769,000 | A | 6/1998 | Dunfey | |
| 5,776,559 | A * | 7/1998 | Woolford | 362/123 |
| 5,787,914 | A | 8/1998 | Greywall | |
| 5,907,127 | A | 5/1999 | Daoud | |
| 5,911,493 | A * | 6/1999 | Walker et al. | 362/102 |
| 6,017,188 | A | 1/2000 | Benton | |
| 6,070,808 | A * | 6/2000 | Kildow | 239/146 |

(Continued)

FOREIGN PATENT DOCUMENTS

EP 0851178 * 7/1998

(Continued)

*Primary Examiner*—Winnie Yip
(74) *Attorney, Agent, or Firm*—McAndrews, Held & Malloy, Ltd.

(57) ABSTRACT

A powered patio pole umbrella is provided. The powered patio pole umbrella receives power from an external outlet and provides power to a plurality of power hubs including electrical outlets positioned vertically within the central pole of the umbrella. Consumers may plug electrical devices into the electrical outlets in the power hubs. The power hubs are sealed for moisture and a ground fault circuit interrupter is provided for additional safety.

29 Claims, 20 Drawing Sheets

U.S. PATENT DOCUMENTS

| | | | | |
|---|---|---|---|---|
| 6,126,293 | A | 10/2000 | Wu | |
| 6,209,147 | B1 * | 4/2001 | Wheaton | 248/534 |
| 6,270,230 | B1 | 8/2001 | Mai | |
| 6,323,431 | B1 | 11/2001 | Lin | |
| 6,402,547 | B1 * | 6/2002 | DeGutis et al. | 439/502 |
| 6,439,249 | B1 | 8/2002 | Pan et al. | |
| D467,877 | S | 12/2002 | Mori et al. | |
| 6,598,990 | B1 | 7/2003 | Li | |
| 6,612,713 | B1 * | 9/2003 | Kuelbs | 362/102 |
| 6,627,816 | B1 | 9/2003 | Walker et al. | |
| 6,659,616 | B1 | 12/2003 | Bilotti | |
| 6,668,845 | B1 | 12/2003 | Lin et al. | |
| 6,679,622 | B1 | 1/2004 | Kao | |
| 6,722,381 | B1 | 4/2004 | Lai | |
| 2004/0100791 | A1 * | 5/2004 | Bilotti et al. | 362/102 |

FOREIGN PATENT DOCUMENTS

| | | |
|---|---|---|
| GB | 2222942 | 3/1990 |

* cited by examiner

POWERED PATIO POLE UMBRELLA

CROSS-REFERENCE TO RELATED APPLICATIONS

The present application is a nonprovisional application which claims the benefit of U.S. Provisional Application No. 60/448,704, filed Feb. 18, 2003, entitled "Power Pole Patio Umbrella" and U.S. Provisional Application No. 60/541,526, filed Feb. 3, 2004, also entitled "Power Pole Patio Umbrella."

BACKGROUND OF THE INVENTION

The present invention generally relates to a patio pole umbrella. More particularly, the present invention relates to a powered patio pole umbrella with electrical outlets for powering appliances, lights, and other devices.

Patio pole umbrellas are currently in wide use by consumers in a variety of applications and settings. A patio pole umbrella is typically installed outdoors to provide shade on a sunny day or shelter from rain on an overcast day. Individuals may sit under the patio pole umbrella by itself, but frequently the patio pole umbrella is installed with a patio table or serving center.

When used with a patio table or serving center, a patio pole umbrella is typically installed with the pole of the umbrella rising up through a hole in the patio table or serving center. To help maintain the balance and vertical position of the patio pole umbrella, the bottom of the pole is sometimes set in a support base.

As an added convenience, the pole sometimes includes an umbrella crank handle for opening and closing the umbrella canopy. The umbrella crank handle is connected to a crank wire that runs up the pole and connects to the support structure of the umbrella canopy. To open and close the umbrella, a user rotates the umbrella crank handle. Rotation of the umbrella crank handle draws or releases the crank wire depending on the direction of rotation. Movement of the crank wire moves the support structure which in turn opens or closes the umbrella canopy.

To further enjoy time spent outdoors under a patio pole umbrella, individuals sometimes bring a radio, television, lights, or other electrical devices out near the patio umbrella. Because such devices require electricity, routing power cords to, from, and around the patio pole umbrella may become cumbersome. Multiple power cords lying around the patio pole take up usable space and present a potential hazard. Consequently, consumers may prefer to reduce the presence of power cords around a patio pole umbrella while still being able to run electrical appliances and other devices.

One way consumers may choose to hide a power cord is to strap the power cord to the surface of the pole of the patio pole umbrella. By securing the power cords near the pole, usable space around the pole is freed up and the potential for inadvertent contact with people is reduced.

For example, a design for a patio pole umbrella lighting system is disclosed in Rushing, U.S. Pat. No. 5,053,931. The system of Rushing shows lights attached to the ribs of an umbrella with zip ties. A power cord for the lights is trained down from the umbrella along the pole of the patio pole umbrella. The power cord is secured to the outside surface of the pole with zip ties.

Another example, is a design for an illuminated garden umbrella disclosed in Finkel, U.S. Pat. No. 2,087,537. The system of Finkle shows a light fixture situated in the top of a garden umbrella. A one-piece, continuous power cord for the light fixture is run from the light fixture to the base of the pole through the inside of the pole. The one-piece, continuous power cord exits the pole at the base of the pole.

While some consumers choose to strap a power cord to the pole, affixing the power cords to the pole in such a manner does not provide for mobility of the electrical devices attached to the power cords or flexibility in changing from the use of electrical one device to another. Also, affixing power cords to the pole does nothing to reduce the number of power cords running around the base of the patio umbrella. Thus, simply securing power cords near the pole of the patio pole umbrella does not provide an optimal solution to management of power cords and wires where an individual desires to alternate the use of various electrical devices near a patio pole umbrella.

For example, a consumer may have a patio pole umbrella installed in the center of a patio table in the backyard of the consumer's home. While sitting at the patio table out in the backyard, the consumer may desire to power a small cooler sitting beneath the table, listen to a radio sitting on the table top, and power a lamp secured up near the umbrella canopy. With a typical patio pole umbrella, the consumer could power the cooler, radio, and lamp in one of two ways: 1) the consumer could run a designated power cord for each device from a household outlet, across the yard, to the patio table; or 2) the consumer could run a single power cord across the yard to a typical household power strip laying on the ground and run power cords from the power strip to each of the cooler, radio, and lamp.

Having numerous power cords strewn across the yard, draped over the edges of the patio table, and hanging from above poses an inconvenient and hazardous situation. The more power cords that are running across the yard and on top of the table, the greater the chances that someone will accidentally stumble over a power cord and/or get snagged on a power cord. Not only could people get hurt by stumbling over the power cords or snagging the power cords, but the electrical devices attached to power cords could be damaged, as well.

For example, in the first scenario presented above, designated power cords may be run from household outlets to each of the cooler, the radio, and the lamp. Each of the power cords may be trained from the outlet, across the yard, to the patio table. The cord for the cooler would be trained on the ground. The cord for the radio sitting on top of the table would run across the table top, over the edge of the table and down to the ground level. The power cord for the lamp would hang down from the top of the umbrella to the table top, run across the table top, lay over the edge of the table, and then hang down to the ground.

In the second scenario, a single power cord may be run from a household outlet to a power strip lying on the ground. Power cords for each of the devices would then be run to the power strip instead of all the way back to outlets at the house. Similar to the first scenario, the cord for the cooler would be trained across the ground to the power strip. The cord for the radio sitting on top of the table would run across the table top, over the edge of the table, and down to the power strip. The power cord for the lamp would hang down from the top of the umbrella to the table top, run across the table top, lay over the edge of the table, and hang down to the power strip.

In either of the two scenarios above, the power cords are strewn all over the table top and hanging in the way of individuals trying to use the patio table. Essentially, the power cords are creating an obstacle course in the vicinity of the patio pole umbrella.

Additionally, the presence of water near electrical devices and cords is of great concern in the outdoor environment. In the above examples, moisture may permeate the junction between the extension cords and the appliance cords or may enter the power strip. Either condition may lead to potentially dangerous shock or electrocution conditions. Such a scenario becomes more likely when the cord or power strip are subjected to rain or are near a pool area where splashing may occur. Such use of extension cords in outdoor, water-exposed environments is specifically forbidden by must safety standards, including those promulgated by Underwriter's Labs (UL), for example.

In order to reduce the clutter associated with powering electrical devices under a patio pole umbrella and free up precious usable space, it may be desirable to have a patio pole umbrella with a wire management system for reducing the presence of power cords under the patio pole umbrella. It may also be highly desirable to have a patio pole umbrella with a wire management system that provides flexibility as to what types of devices may be provided power. It may also be highly desirable to have a patio umbrella with a wire management system that provides the convenience of being able to readily change the devices being powered with minimal effort. It may also be highly desirable to have a wire management solution that minimizes the risk of shock or electrocution and conforms with applicable safety standards. Additionally, it may be highly desirable for the consumer to have access to power outlets at the umbrella or umbrella/patio table in order to power electrical devices and/or appliances that the user may want to use. That is, the availability of power where the consumer needs it (e.g., at the patio table) may be highly desirable.

BRIEF SUMMARY OF THE INVENTION

A preferred embodiment of the present invention provides a powered patio pole umbrella. Power is received by the powered patio pole umbrella from a wall outlet through a cord equipped with a ground fault circuit interrupter. The cord plugs into a bi-directional power hub located in the lower portion of the central pole of the powered patio pole umbrella, but displaced vertically upward from the ground. Power is then supplied from the bi-directional power hub to a plurality of other power hubs located vertically along the powered patio pole umbrella. The power hubs are sealed for moisture and the ground fault circuit interrupter is provided for additional safety

DETAILED DESCRIPTION OF THE INVENTION

Figure 1:
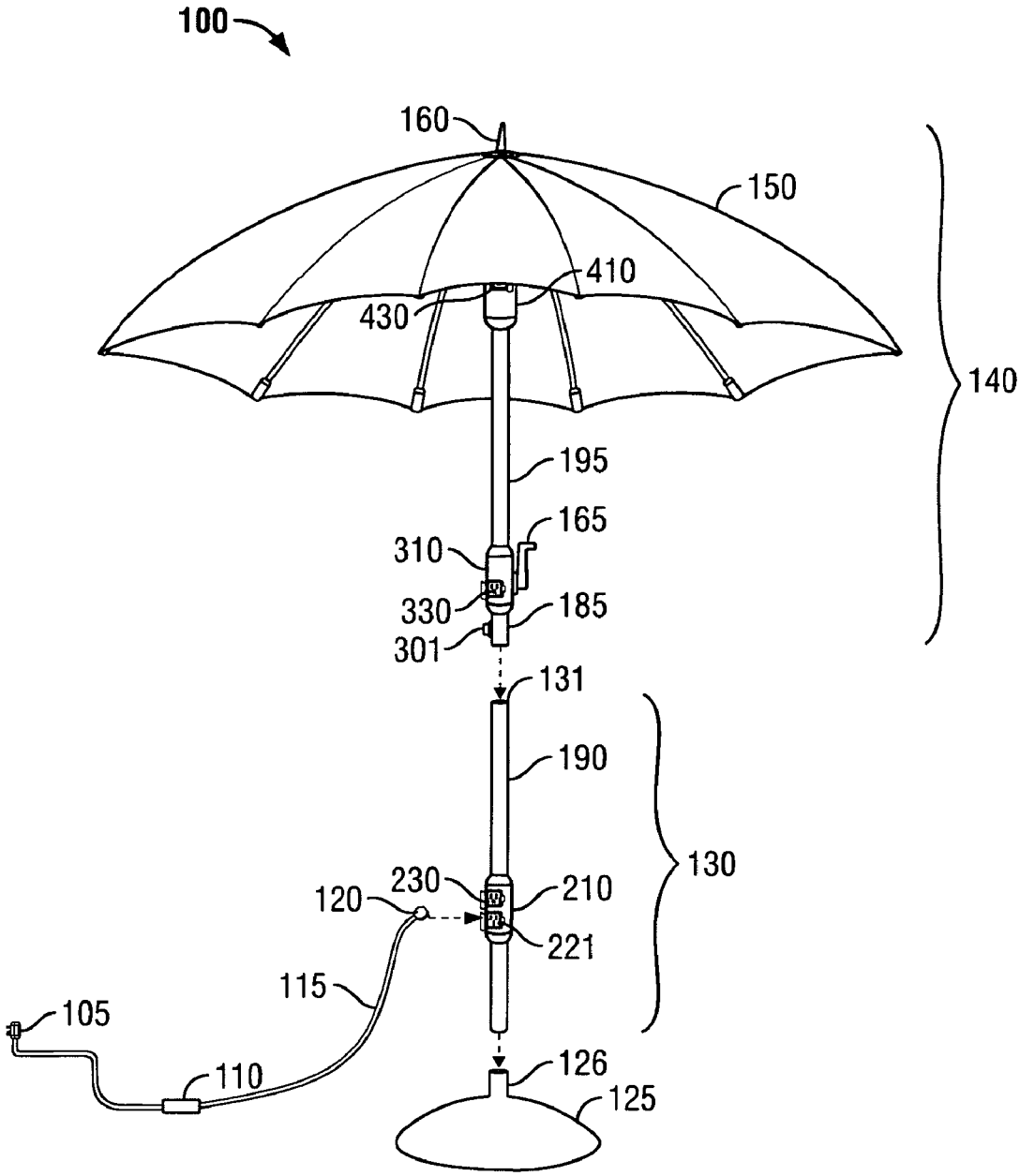
FIG. 1 illustrates a powered patio pole umbrella in accordance with an embodiment of the present invention.

FIG. 1 illustrates a powered patio pole umbrella 100 in accordance with an embodiment of the present invention. The powered patio pole umbrella 100 includes a power cord 115, support base 125, a powered bottom pole section 130, and a powered top pole section 140. The support base 125 includes a support aperture 126. The powered bottom pole section 130 includes a pole connection aperture 131, a bottom tube 190, a bi-directional power hub 210, an input power receptacle 221, and a bottom power outlet 230. The powered top pole section 140 includes an umbrella canopy 150, an umbrella cap 160, an umbrella crank handle 165, a pole connection piece 185, a top tube 195, a pole section slip restraint 301, a mid-level power hub 310, a mid-level power outlet 330, a top power hub 410, and a top power outlet 430. The power cord 115 includes an outlet plug 105, a male power input connector 120, and a ground fault circuit interrupter 110.

The bottom tube 190 of the powered bottom pole section 130 slides into the support aperture 126 of the support base 125. The pole section slip restraint 301 depresses into the pole connection piece 185 of the powered top pole section 140. With the pole section slip restraint 301 depressed, the pole connection piece 185 slides into the pole connection aperture 131 of the powered bottom pole section 130. The pole connection piece 185 is positioned within the pole connection aperture 131 such that the pole section slip restraint 301 aligns with a hole in the sidewall of the bottom tube 190. The hole in the sidewall of the bottom tube 190 is sized to receive the pole section slip restraint 301 as the pole section slip restraint 301 is forced into the hole. Engagement of the pole section slip restraint 301 with the hole in the sidewall of bottom tube 190 prevents rotation and sliding of the top tube 195 with respect to the bottom tube 190.

The female power input connector 120 of the power cord 115 is plugged into the input power receptacle 221 of the powered bottom pole section 130. The outlet plug 105 on the other end of power cord 115 is plugged into an outlet that supplies electrical power.

The powered patio pole umbrella 100 may be used to provide safe and convenient access to a power supply for appliances and other electrical devices. For example, as further described in detail below, electrical devices may be plugged into the bottom power outlet 230, the mid-level power outlet 330, or the top power outlet 430 to reduce the hazards and inconvenience associated with running numerous power cords across a porch, room, or yard in order to plug electrical devices into remote sources of power.

Figure 2:
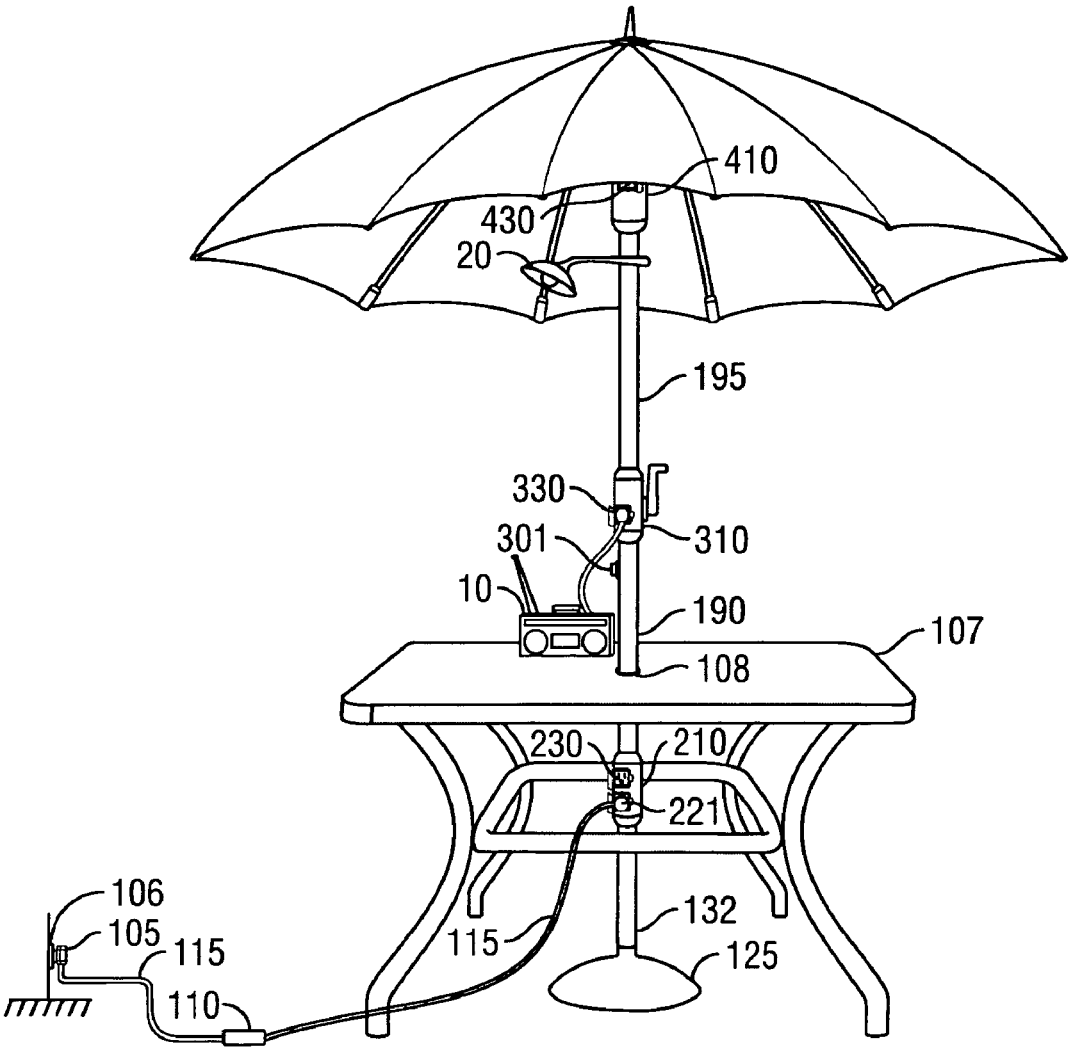
FIG. 2 illustrates the powered patio pole umbrella shown in FIG. 1 installed in a patio table in accordance with an embodiment of the present invention.

FIG. 2 illustrates the powered patio pole umbrella 100 of FIG. 1 installed within a hole 108 in a patio table 107 in accordance with an embodiment of the present invention. On top of the patio table 107, a radio 10 is shown plugged into the mid-level power outlet 330. Clamped to the top tube 195, a lamp 20 is shown plugged into the top power outlet 430.

In operation, the female power input connector 120 of the power cord 115 is plugged into the input power receptacle 221 of the powered bottom pole section 130. On the other end of the power cord 115, the outlet plug 105 is plugged into a power outlet 106.

The power outlet 106 provides electrical power from an AC power source to the outlet plug 105. Electrical power flows from outlet plug 105 through the power cord 115 and the ground fault circuit interrupter 110 to the male power input connector 120. Electrical power flows from the male power input connector 120 into the input power receptacle 221. The input power receptacle 221 supplies electrical power to the bottom power outlet 230, the mid-level power outlet 330, and the top power outlet 430.

To power the radio 10 or another electrical device sitting on top of the patio table 107, the radio 10 or other electrical device may be plugged into the mid-level power outlet 330. To power the lamp 20 or another electrical device positioned near the top of the powered patio pole umbrella 100, the lamp 20 or other electrical device may be plugged into the top power outlet 430.

As shown in FIG. 2, plugging the radio 10, the lamp 20, and other electrical devices into the bottom power outlet 230, the mid-level power outlet 330, and the top power outlet 430 reduces hazards and congestion caused by power cords dangling from the umbrella canopy 150 and draping over the edges of the table 107. Additionally, reduction of power cords dangling from the umbrella canopy 150 above and hanging over the edges of the table 107, reduces the potential for injury to people through incidental contact with power cords.

For example, reduction of power cords dangling from the umbrella canopy 150 above or hanging over the edges of the table 107, reduces the chances of people accidentally hooking a power cord with a body part or other object and accidentally dragging the electrical device off the table. Reduction of power cords above the surface of the table also creates more useable room for other items such as food and reading materials.

Additionally, as shown in FIG. 1, the possibility of water infiltration creating a hazardous shocking condition have been greatly minimized. First, no joining of electric cords occurs at ground level. The outlet plug 105 and input power receptacle are both upwardly vertically displaced from the ground to minimize water penetration. Additionally, the presences of the ground fault circuit interrupter 110 minimizes the possibility of electrocution by being able to interrupt the power supplied if an electrocution condition is occurring.

FIGS. 3, 4, 5, and 6 illustrate the bidirectional power hub 210 in accordance with an embodiment of the present invention. As shown in FIGS. 3–6, the bi-directional power hub 210 includes bi-directional power hub end caps 205, a bi-directional power hub faceplate 212, a solid backplate 211, a bottom outlet cover 220, the input power receptacle 221, an input power receptacle cover 225, and the bottom power outlet 230.

The bottom power outlet 230 and the input power receptacle 221 are mounted inside the bi-directional power hub 210. The bottom outlet cover 220 and the input power receptacle cover 225 are attached with hinges to the bi-directional power hub faceplate 212. The bi-directional power hub end caps 205 encircle the outer surface of the bottom tube 190 and attach to the bi-directional power hub faceplate 212 and the solid backplate 211.

Figure 3:
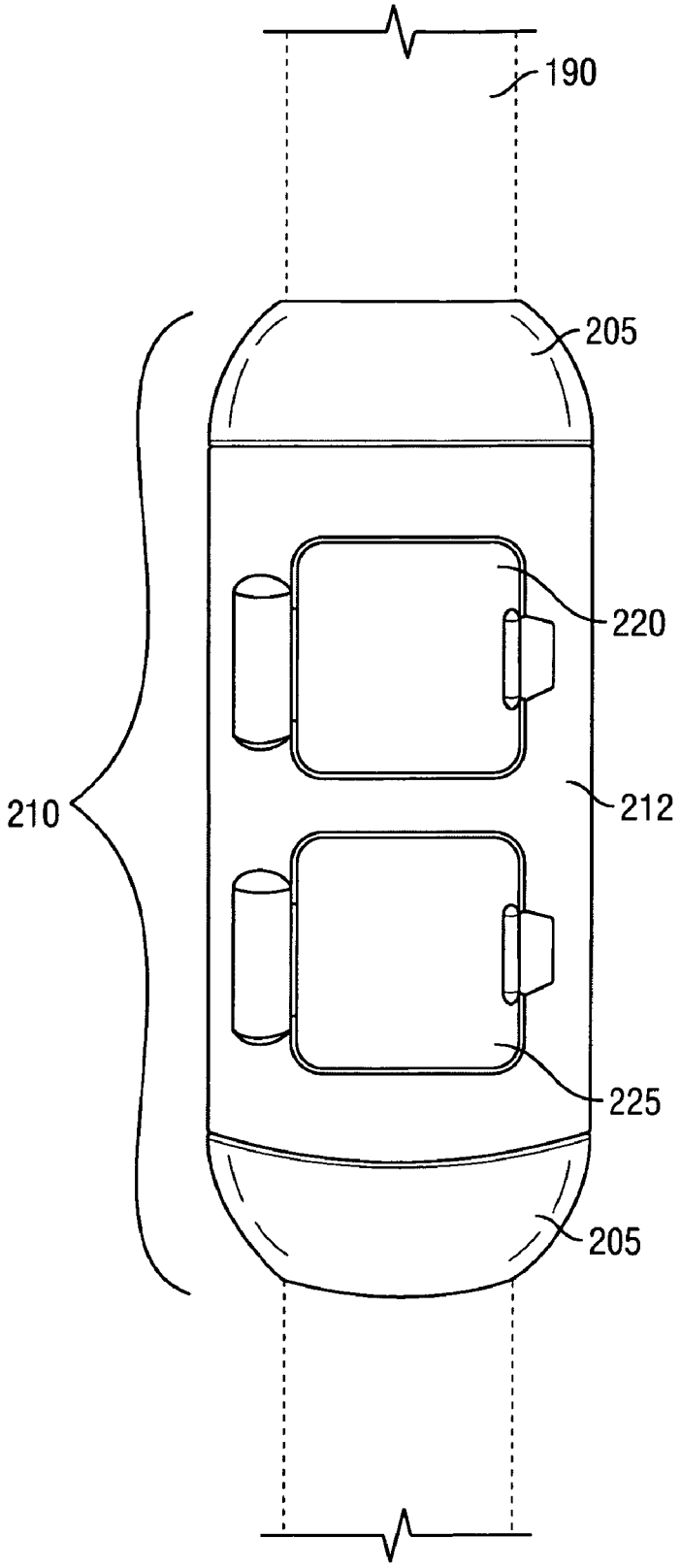
FIG. 3 illustrates a bi-directional power hub in accordance with an embodiment of the present invention.
Figure 4:
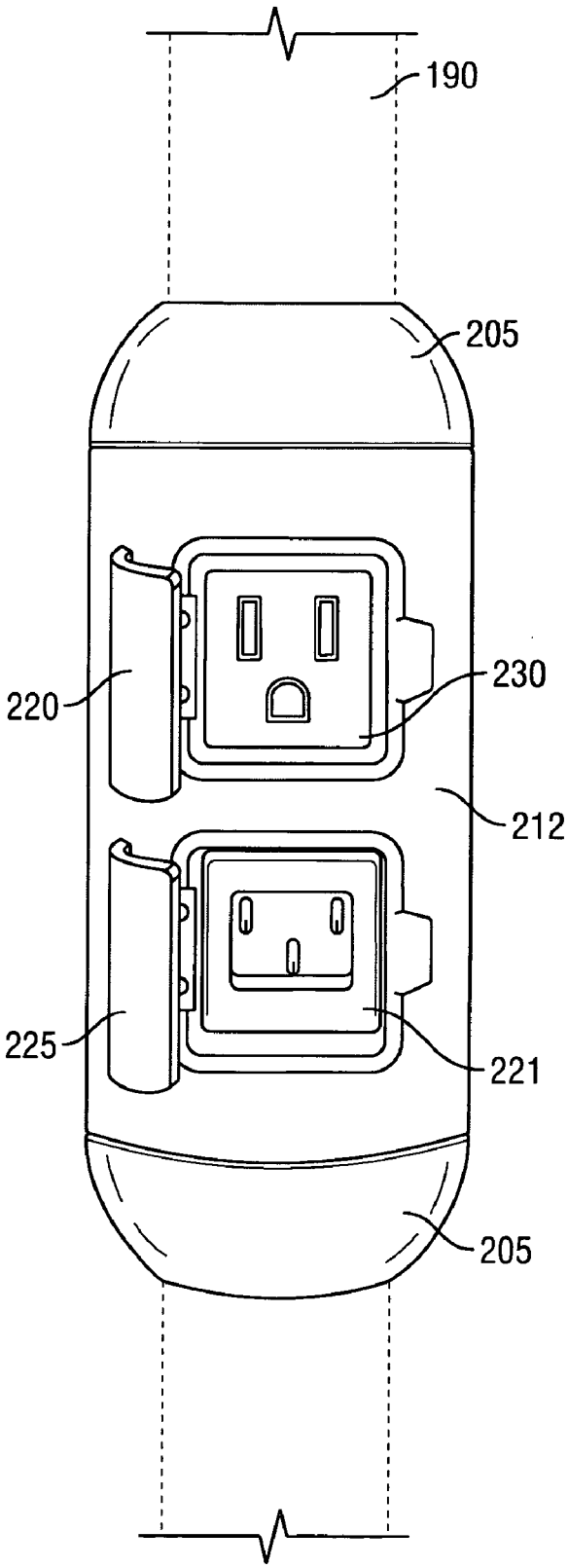
FIG. 4 illustrates the bi-directional power hub shown in FIG. 3 with outlet covers in an open position in accordance with an embodiment of the present invention.
Figure 5:
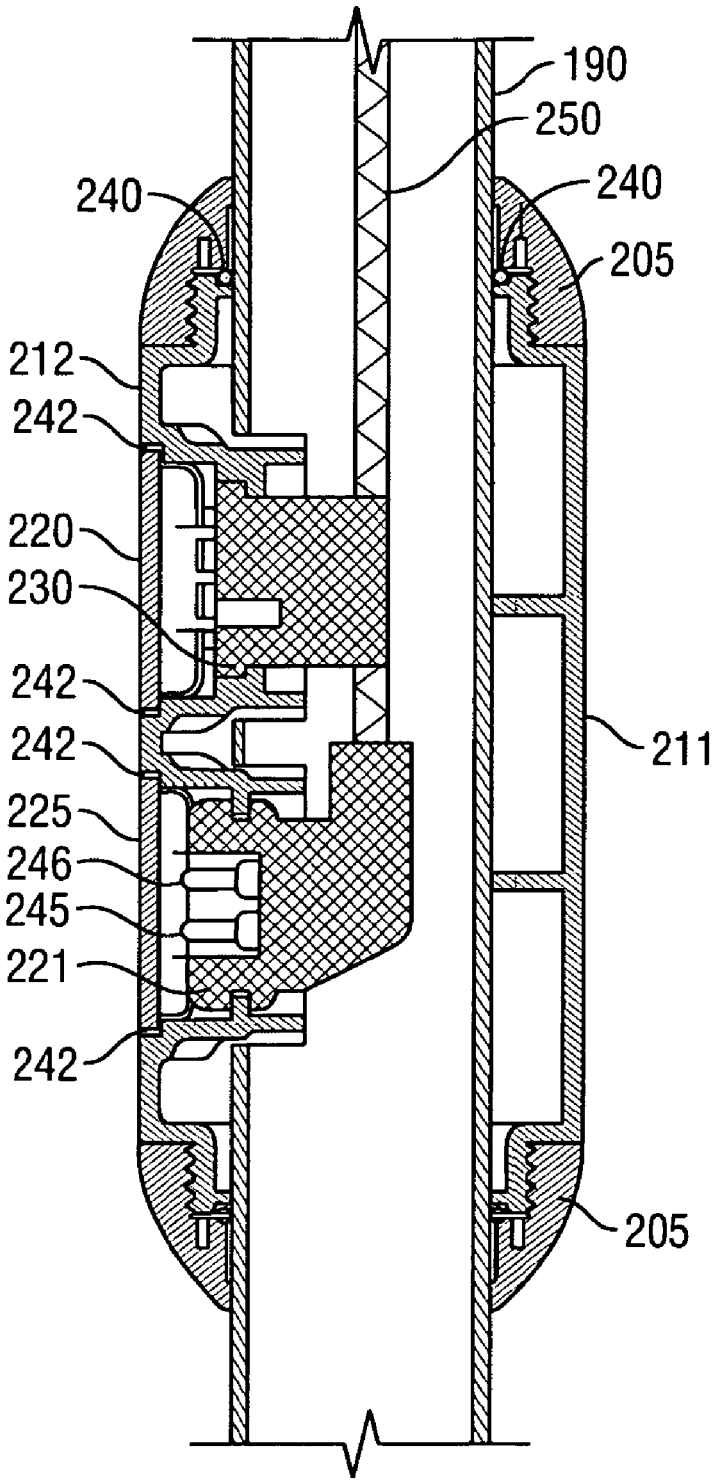
FIG. 5 illustrates a longitudinal cross-sectional view of the bi-directional power hub shown in FIG. 3 in accordance with an embodiment of the present invention.
Figure 6:
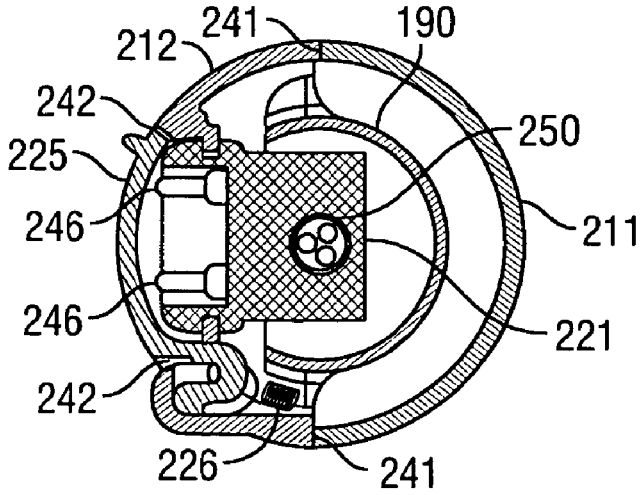
FIG. 6 illustrates a latitudinal cross-sectional view of the bi-directional power hub shown in FIG. 3 in accordance with an embodiment of the present invention.

More specifically, FIGS. 5 and 6 illustrate cross-sectional views of the bi-directional power hub 210 shown in FIGS. 3 and 4. The longitudinal cross-sectional view of the bi-directional power hub 210 in FIG. 5 includes the bottom tube 190, the bi-directional power hub end caps 205, the solid backplate 211, the bi-directional power hub faceplate 212, the bottom outlet cover 220, the input power receptacle 221, the input power receptacle cover 225, the bottom power outlet 230, the bi-directional power hub end cap seal 240, bi-directional power hub faceplate cover seals 242, input ground terminal 245, input power terminals 246, and a bottom section internal power cable 250. The latitudinal cross-sectional view of the bi-directional power hub 210 in FIG. 6 includes the bottom tube 190, the solid backplate 211, the bi-directional power hub faceplate 212, the input power receptacle 221, the input power receptacle cover 225, a cover-closing device 226, bi-directional power hub plate seals 241, the bi-directional power hub faceplate cover seals 242, the input power terminals 246, and the bottom section internal power cable 250.

The bottom section internal power cable 250 is connected to the input power receptacle 221 and the bottom power outlet 230. The bottom section internal power cable 250 continues upward within the bottom tube 190 until it reaches the pole connection aperture 131 shown in FIG. 1 and illustrated in FIG. 7. Near the pole connection aperture 131, the bottom section internal power cable 250 connects to a female internal power connector 260.

The input power receptacle 221 and the bottom power outlet 230 are positioned within openings in the sidewall of the bottom tube 190 and attached to the bi-directional power hub faceplate 212. The bi-directional power hub faceplate 212 and the solid backplate 211 are positioned on opposite sides of the bottom tube 190 with opposing edges pressed together. Threads in the bi-directional power hub end caps 205 engage threads on the bi-directional power hub faceplate 212 and the solid backplate 211. The bi-directional power hub end caps 205 are rotated until tightly seated with the bi-directional power hub faceplate 212 and the solid backplate 211.

To prevent the intrusion of water, dust particles, and other undesired foreign objects into the bi-directional power hub 210, the bi-directional power hub 210 includes the bottom outlet cover 220, the input power receptacle cover 225, the bi-directional power hub end cap seal 240, the bi-directional power hub plate seals 241, and the bi-directional power hub faceplate cover seals 242. The bi-directional power hub end cap seal 240 is placed around the bottom tube 190 along the top of the bi-directional power hub faceplate 212 and the solid backplate 211. As the bi-directional power hub end caps 205 are threaded onto the bi-directional power hub faceplate 212 and the solid backplate 211, the bi-directional power hub end cap seal 240 is compressed between the bi-directional power hub end cap 205 and both the bi-directional power hub faceplate 212 and the solid backplate 211. Compressing the bi-directional power hub end cap seal 240 forces the bi-directional power hub end cap seal 240 against the outer surface of the bottom tube 190 and forms a watertight seal.

In addition to the bi-directional power hub end cap seal 240, the bi-directional power hub 210 includes the bi-directional power hub plate seals 241. The bi-directional power hub plate seals 241 are sandwiched between the shared edges of the bi-directional power hub faceplate 212 and the solid backplate 211. As the bi-directional power hub end caps 205 are threaded onto the bidirectional power hub faceplate 212 and the solid backplate 211, edges of the bi-directional power hub faceplate 212 and the solid backplate 211 are forced together and compress the bi-directional power hub plate seals 241 to form a watertight seal.

To cover the bottom power outlet 230 and the input power receptacle 221 when not in use and reduce the intrusion of water and other particles, the bottom outlet cover 220 and the input power receptacle cover 225 are provided. The bottom outlet cover 220 and the input power receptacle cover 225 are positioned over the bottom power outlet 230 and the input power receptacle 221. The bottom outlet cover 220 and the input power receptacle cover 225 are attached to the bi-directional power hub faceplate 212 with hinges. To insert a plug into either the bottom power outlet 230 or the input power receptacle 221, the bottom outlet cover 220 or the input power receptacle cover 225 may be rotated into the open position as shown in FIG. 4. When a plug is removed from the either the bottom power outlet 230 or the input power receptacle 221, the bottom outlet cover 220 or the input power receptacle cover 225 is rotated into a closed position as shown in FIG. 3.

To assist in closing the bottom outlet cover 220 and the input power receptacle cover 225, cover-closing devices 226 are attached to each of the bottom outlet cover 220 and the input power receptacle cover 225. The cover-closing devices 226 are anchored to the bi-directional power hub faceplate 212. The cover-closing devices 226 exert a force on the bottom outlet cover 220 and the input power receptacle cover 225 that causes the outlet cover 220 and the input power receptacle cover 225 to rotate into the closed position.

To further prevent moisture, dirt, and other foreign objects from entering through gaps between the bi-directional power hub faceplate 212 and edges of both the bottom outlet cover 220 and the input power receptacle cover 225, a bidirectional power hub faceplate cover seal 242 may be installed around the edges of the bottom outlet cover 220 and the input power receptacle cover 225. With the bottom outlet cover 220 and the input power receptacle cover 225 in the closed position, the bidirectional power hub faceplate cover seals 242 fill the gaps between the bidirectional power hub faceplate 212 and edges of both the bottom outlet cover 220 and the input power receptacle cover 225.

Consequently, the coverage and seals provided by the bi-directional power hub end cap seal 240, the bi-directional power hub plate seals 241, the bidirectional power hub faceplate cover seals 242, the bottom outlet cover 220, and the input power receptacle cover 225 help prevent moisture and other materials from entering the bi-directional power hub 210.

FIGS. 8, 9, 10 and 11 illustrate the mid-level power hub 310 in accordance with an embodiment of the present invention. As shown in FIGS. 8–11, the mid-level power hub 310 includes an umbrella crank handle 165, mid-level power hub end caps 305, a handle backplate 311, a mid-level power hub faceplate 312, a mid-level outlet cover 320, and a mid-level power outlet 330.

The mid-level power outlet 330 is mounted inside the mid-level power hub 310. The mid-level outlet cover 320 is attached with a hinge to the mid-level power hub faceplate 312. The mid-level power hub end caps 305 encircle the outer surface of the top tube 195 and attach to the mid-level power hub faceplate 312 and the handle backplate 311.

The umbrella crank handle 165 is used to open and close the umbrella canopy 150 on top of the powered patio pole umbrella 100. The umbrella crank handle 165 seats in a hole in the handle backplate 311 of the mid-level power hub 310.

To open and close the umbrella canopy 150, an individual rotates the umbrella crank handle 165. Rotation of the umbrella crank handle 165 controls a canopy crank wire that is connected to a support structure of the umbrella canopy 150.

Figure 8:
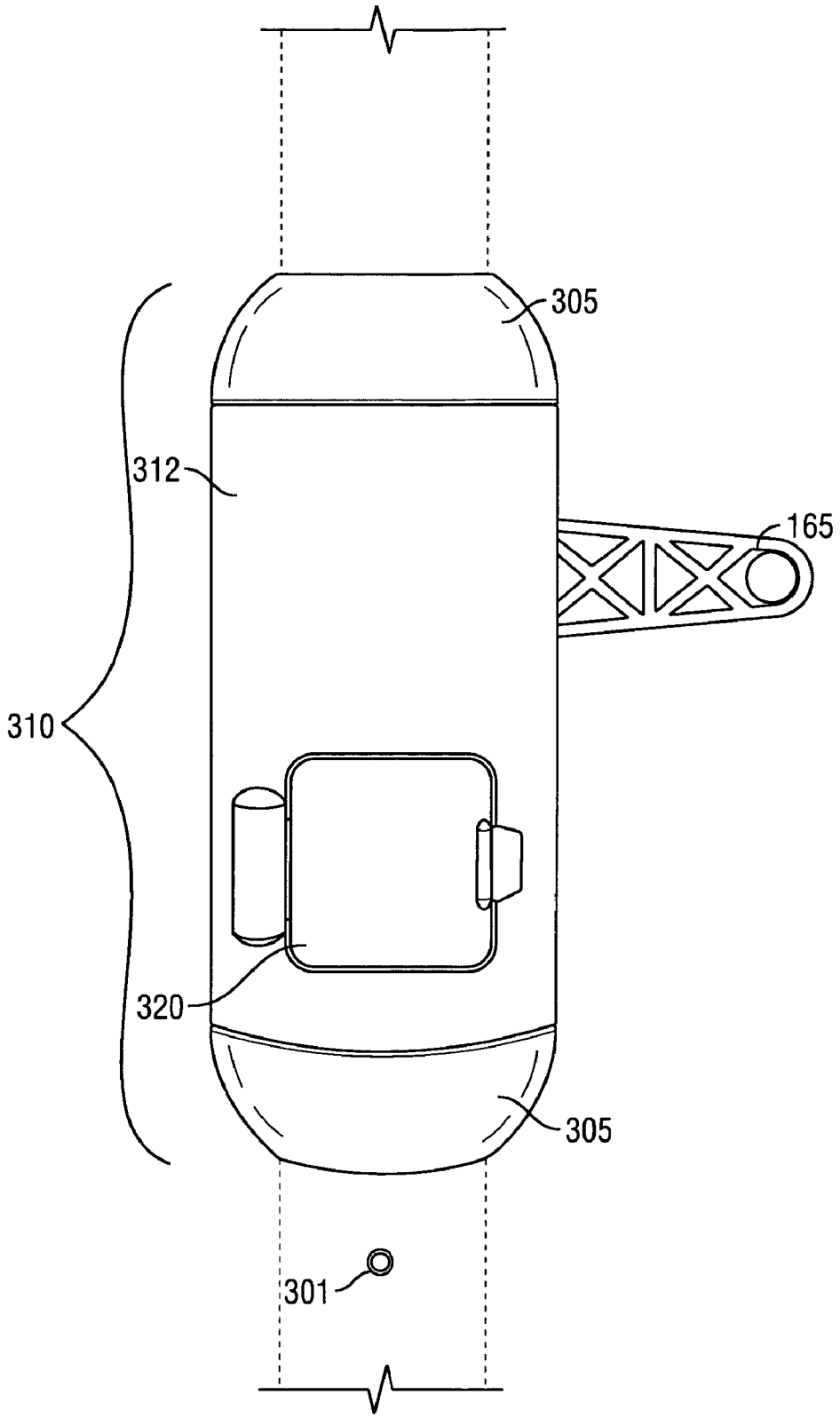
FIG. 8 illustrates a mid-level power hub in accordance with an embodiment of the invention.
Figure 9:
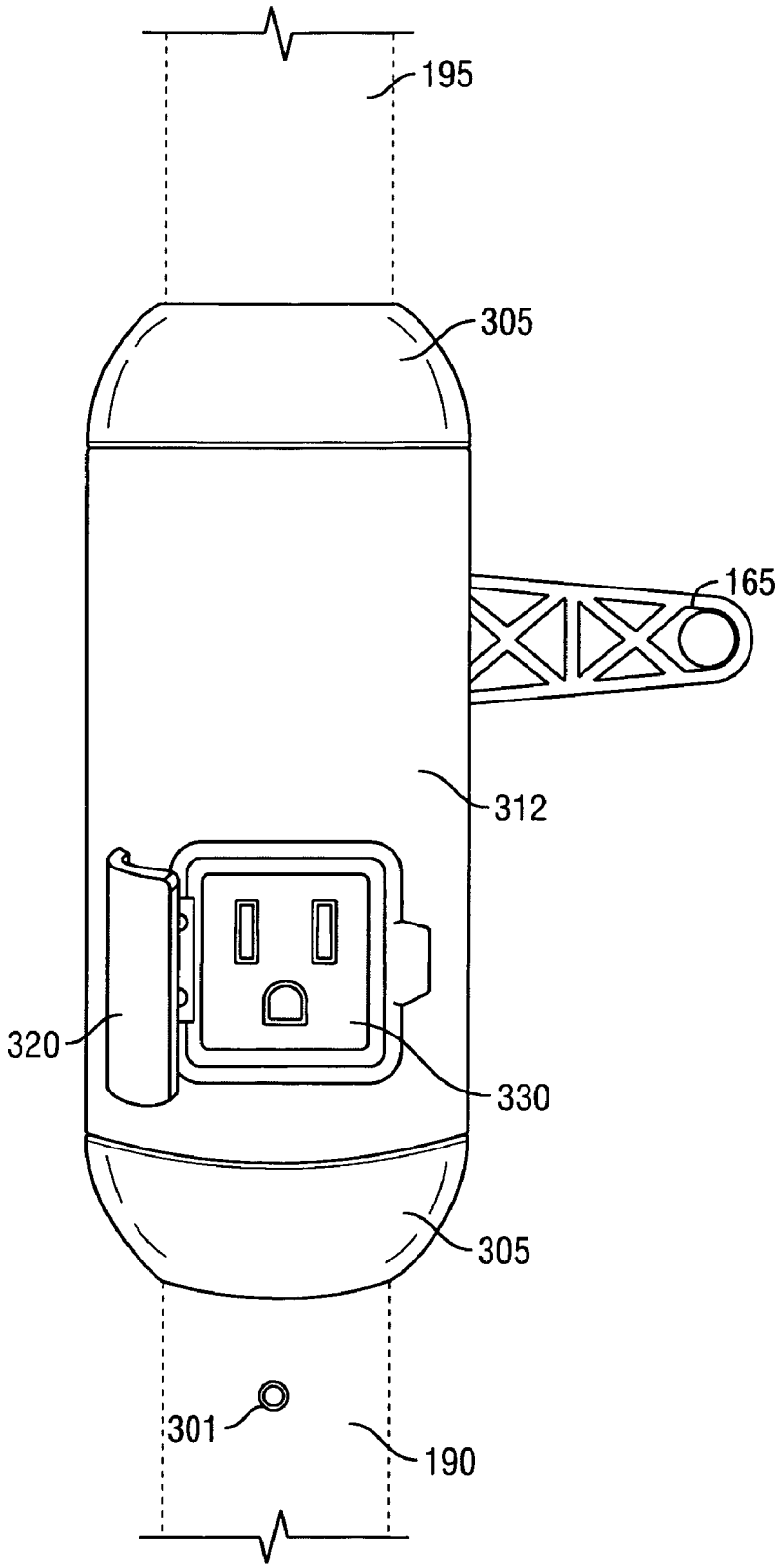
FIG. 9 illustrates the mid-level power hub shown in FIG. 8 with an outlet cover in an open position in accordance with an embodiment of the present invention.
Figure 10:
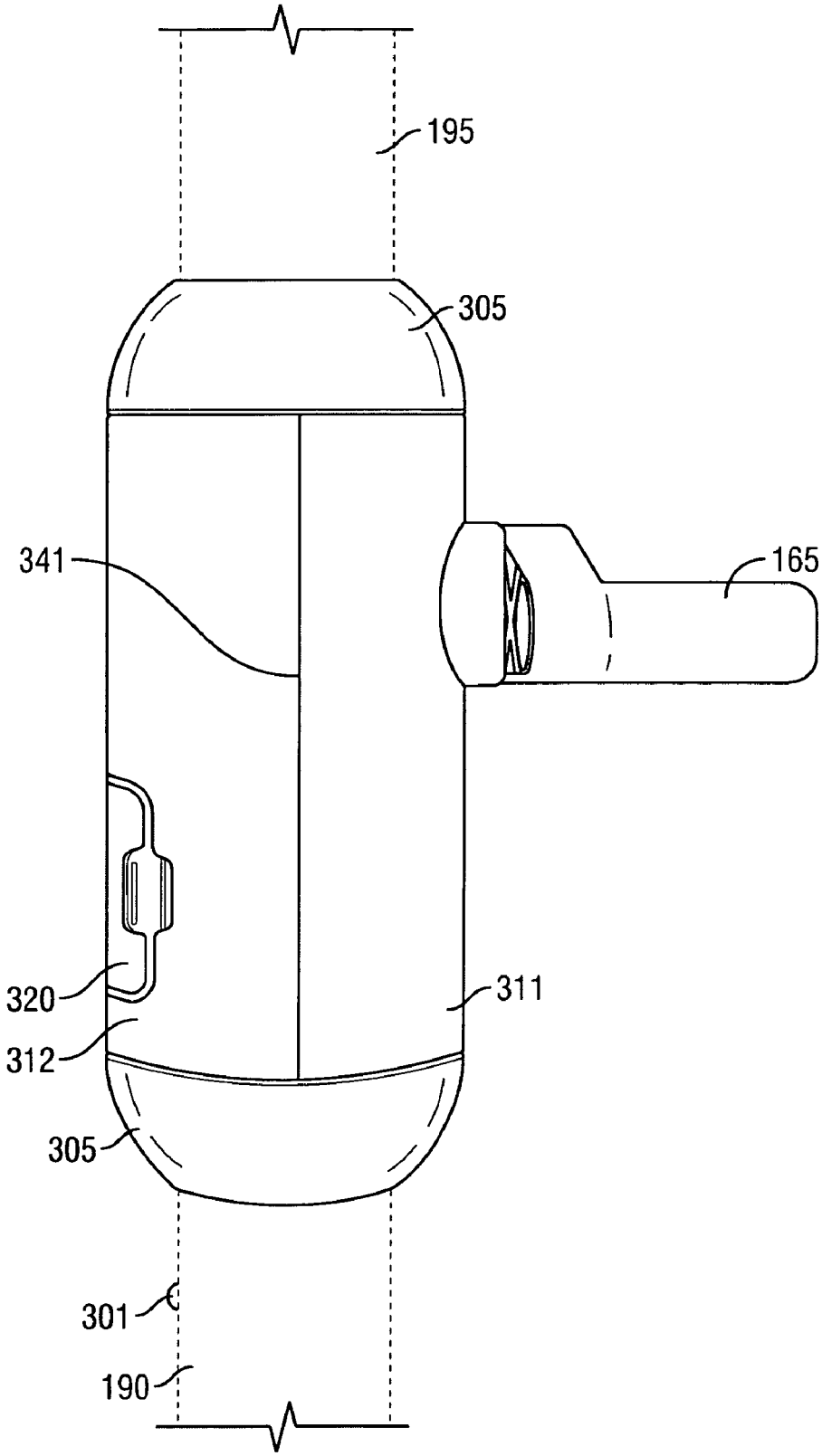
FIG. 10 illustrates a side view of the mid-level power hub shown in FIG. 8 in accordance with an embodiment of the present invention.
Figure 11:
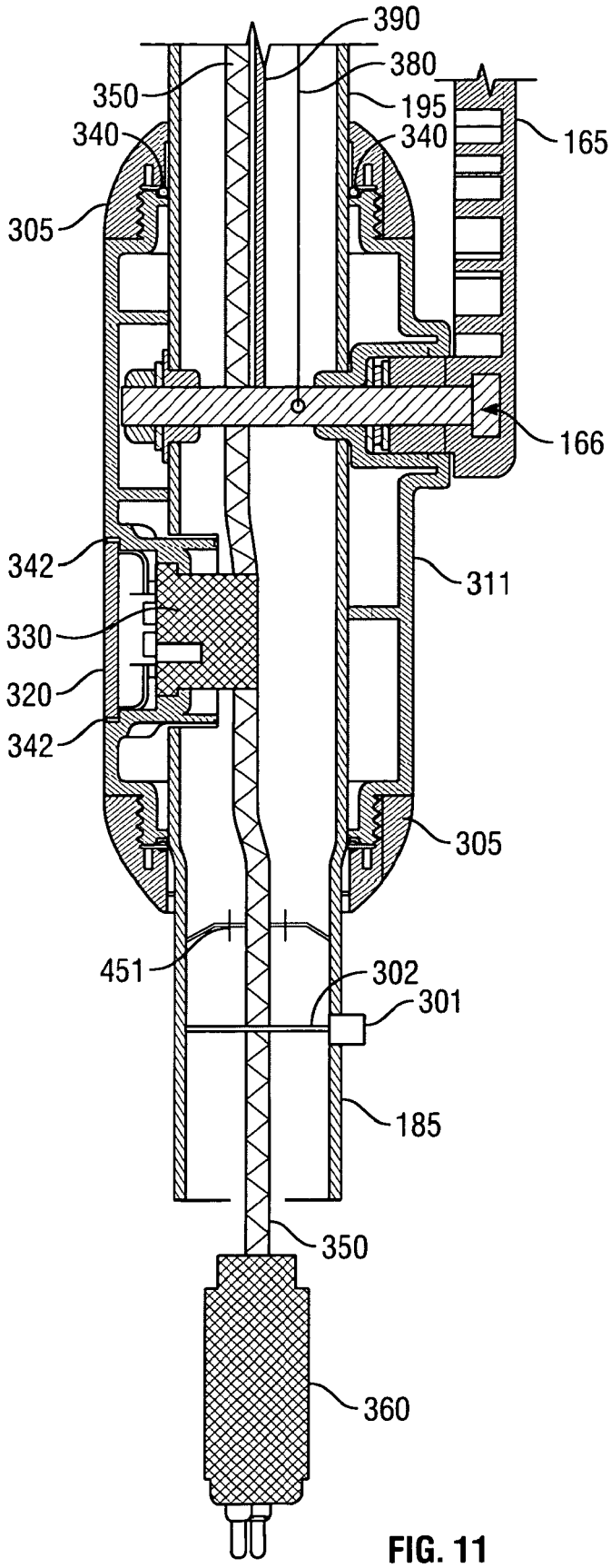
FIG. 11 illustrates a longitudinal cross-sectional view of the mid-level power hub shown in FIG. 8 with a separable male internal power connector within the patio pole umbrella in accordance with an embodiment of the present invention.

FIG. 11 illustrates a longitudinal cross-sectional view of the mid-level power hub 310 shown in FIGS. 8–10. The longitudinal cross-sectional view of the mid-level power hub 310 in FIG. 11 includes the umbrella crank handle 165, the pole connection piece 185, the top tube 195, the pole section slip restraint 301, a pole section slip restraint ring 302, the mid-level power hub end caps 305, the handle backplate 311, the mid-level power hub faceplate 312, the mid-level outlet cover 320, the mid-level power outlet 330, the mid-level power hub end cap seal 340, a top section internal power cable 350, a male internal power connector 360, a canopy crank wire 380, and an internal separation device 390.

Figure 7:
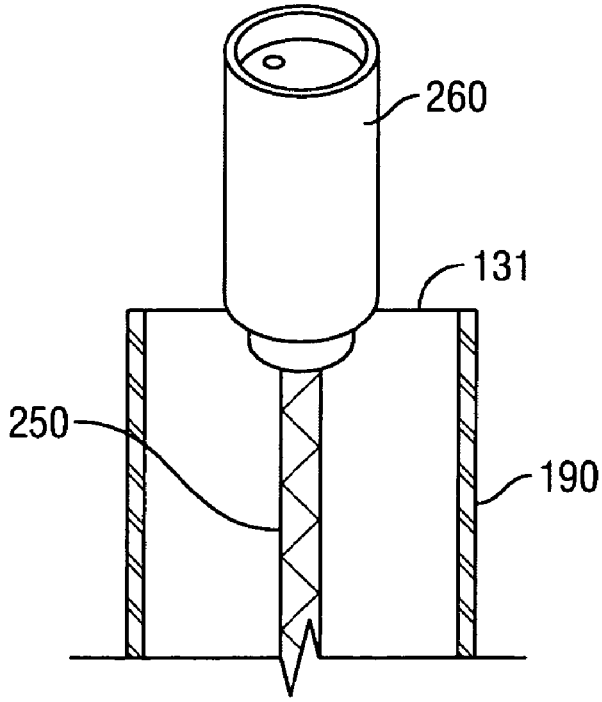
FIG. 7 illustrates a separable female internal power connector within the patio pole umbrella in accordance with an embodiment of the present invention.

The male internal power connector 360 from the powered top pole section 140 is plugged into the female internal power connector 260 from the powered bottom pole section 130 shown in FIG. 7. The male internal power connector 360 is connected to the top section internal power cable 350. The top section internal power cable 350 is trained inside the powered top pole section 140. Beginning at the male internal power connector 360, the top section internal power cable 350 runs inside the pole connection piece 185 and the top tube 195 to the mid-level power outlet 330. The top section internal power cable 350 is connected to the mid-level power outlet 330. The top section internal power cable 350 continues upward from the mid-level power outlet 330 towards the top of the powered patio pole umbrella 100.

The mid-level power outlet 330 is positioned within an opening in the sidewall of the top tube 195 and the mid-level power outlet 330 is attached to the mid-level power hub faceplate 312. The mid-level power hub faceplate 312 and the handle backplate 311 are positioned on opposite sides of the top tube 195 with opposing edges pressed together. Threads in the mid-level power hub end caps 305 engage threads on the mid-level power hub faceplate 312 and the handle backplate 311. The mid-level power hub end caps 305 are rotated until tightly seated with the mid-level power hub faceplate 312 and the handle backplate 311.

To prevent the intrusion of water, dust particles, and other undesired foreign objects into the mid-level power hub 310, the mid-level power hub 310 includes the mid-level outlet cover 320, the mid-level power hub end cap seal 340, the mid-level power hub plate seals 341, and the mid-level power hub faceplate cover seals 342. The mid-level power hub end cap seal 340 is placed around the top tube 195 along the top of the mid-level power hub faceplate 312 and the handle backplate 311. As the mid-level power hub end caps 305 are threaded onto the mid-level power hub faceplate 312 and the handle backplate 311, the mid-level power hub end cap seal 340 is compressed between the mid-level power hub end cap 305 and both the mid-level power hub faceplate 312 and the handle backplate 311. Compressing the mid-level power hub end cap seal 340 forces the mid-level power hub end cap seal 340 against the outer surface of the top tube 195 and forms a watertight seal.

In addition to the seal, all power hubs, including the mid-level power hub may be equipped with a drain in the bottom power hub end cap 305. The drain may allow any moisture entering the power hub to exit the power hub under the force of gravity.

In addition to the mid-level power hub end cap seal 340, the mid-level power hub 310 includes the mid-level power hub plate seals 341. The mid-level power hub plate seals 341 are sandwiched between the shared edges of the mid-level power hub faceplate 312 and the handle backplate 311. As the mid-level power hub end caps 305 are threaded onto the mid-level power hub faceplate 312 and the handle backplate 311, edges of the mid-level power hub faceplate 312 and the handle backplate 311 are forced together and compress the mid-level power hub plate seals 341 to form a watertight seal.

To cover the mid-level power outlet 330 when not in use and reduce the intrusion of water and other particles, the mid-level outlet cover 320 is provided. The mid-level outlet cover 320 is positioned over the mid-level power outlet 330. The mid-level outlet cover 320 is attached to the mid-level power hub faceplate 312 with a hinge. To insert a plug into the mid-level power outlet 330, the mid-level outlet cover 320 may be rotated into the open position as illustrated in FIG. 9. When a plug is removed from the mid-level power outlet 330, the mid-level outlet cover 320 is rotated into a closed position as illustrated in FIG. 8.

To assist in closing the mid-level outlet cover 320, a cover-closing device 226 like that used in the bi-directional power hub 210 is attached to the mid-level outlet cover 320. The cover-closing device 226 is anchored to the mid-level power hub faceplate 312. The cover-closing device 226 exerts a force on the mid-level outlet cover 320 that causes the mid-level outlet cover 320 to rotate into the closed position. 84 To further prevent moisture, dirt, and other foreign objects from entering through gaps between the mid-level power hub faceplate 312 and edges of the mid-level outlet cover 320, a mid-level power hub faceplate cover seal 342 may be installed around the edges of the mid-level outlet cover 320. With the mid-level outlet cover 320 in the closed position, the mid-level power hub faceplate cover seals 342 fill the gaps between the mid-level power hub faceplate 312 and edges of the mid-level outlet cover 320.

Additionally, all outlet covers may alternatively be equipped with a seal, such as an elastic washer seal, around the perimeter of the outlet cover with further minimize water intrusion. Alternatively or in addition to the above, the outlet covers may be equipped with a drain at the bottom of the outlet covers to allow water to drain out in cease water enters the outlet cover.

The internal separation device 390 is positioned inside the top tube 195 between the top section internal power cable 350 and the canopy crank wire 380 to prevent contact between the top section internal power cable 350 and the canopy crank wire 380. The internal separation device 390 is preferably an good insulator that is rigidly positioned between the internal power cable 350 and the canopy crank wire 380. Although the internal power cable 350 is preferably already insulated, the internal separation device adds an additional measure of protection to safeguard the consumer.

For example, to open and close the umbrella canopy 150, the umbrella crank handle 165 is turned. Turning the umbrella crank handle 165 rotates the crank bolt 166. As the crank bolt 166 is rotated, the canopy crank wire 380 wraps or unwraps from around the crank bolt 166. Friction between the moving canopy crank wire 380 and the top section internal power cable 350 may damage the top section internal power cable 350 and/or the canopy crank wire 380.

For example, friction between the canopy crank wire 380 and the top section internal power cable 350 may damage insulation coatings on the top section internal power cable 350 and expose conductors inside the top section internal power cable 350. Contact between exposed conductors inside the top section internal power cable 350 and other parts of the powered patio pole umbrella 100 may unintentionally electrify portions of the powered patio pole umbrella 100. Contact between a person and the unintentionally electrified portions of the powered patio pole umbrella 100 may shock or electrocute the person. Consequently, the internal separation device 390 is positioned between the top section internal power cable 350 and the canopy crank wire 380 to prevent contact between the top section internal power cable 350 and the canopy crank wire 380.

Figure 12:
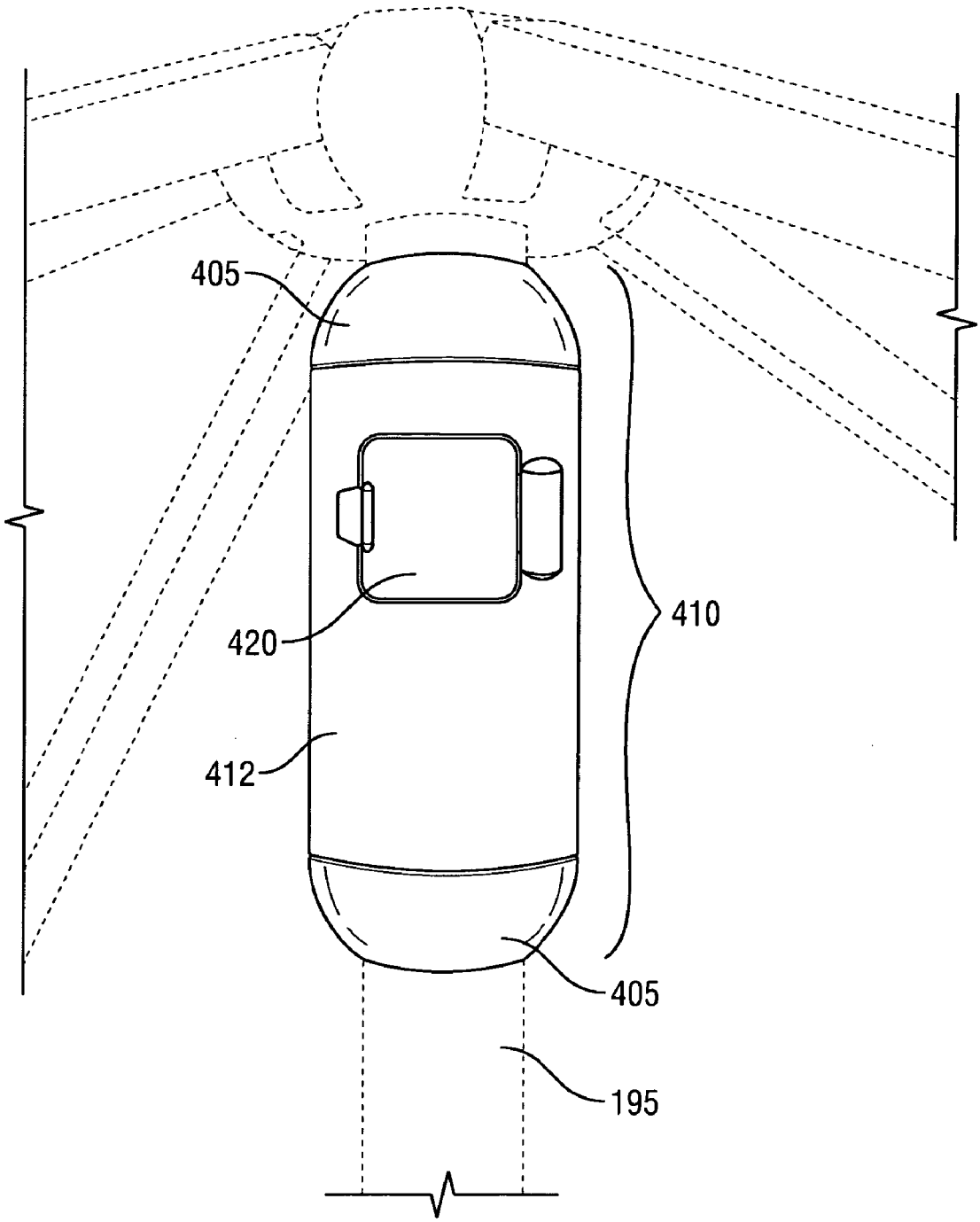
FIG. 12 illustrates a top power hub in accordance with an embodiment of the present invention.
Figure 13:
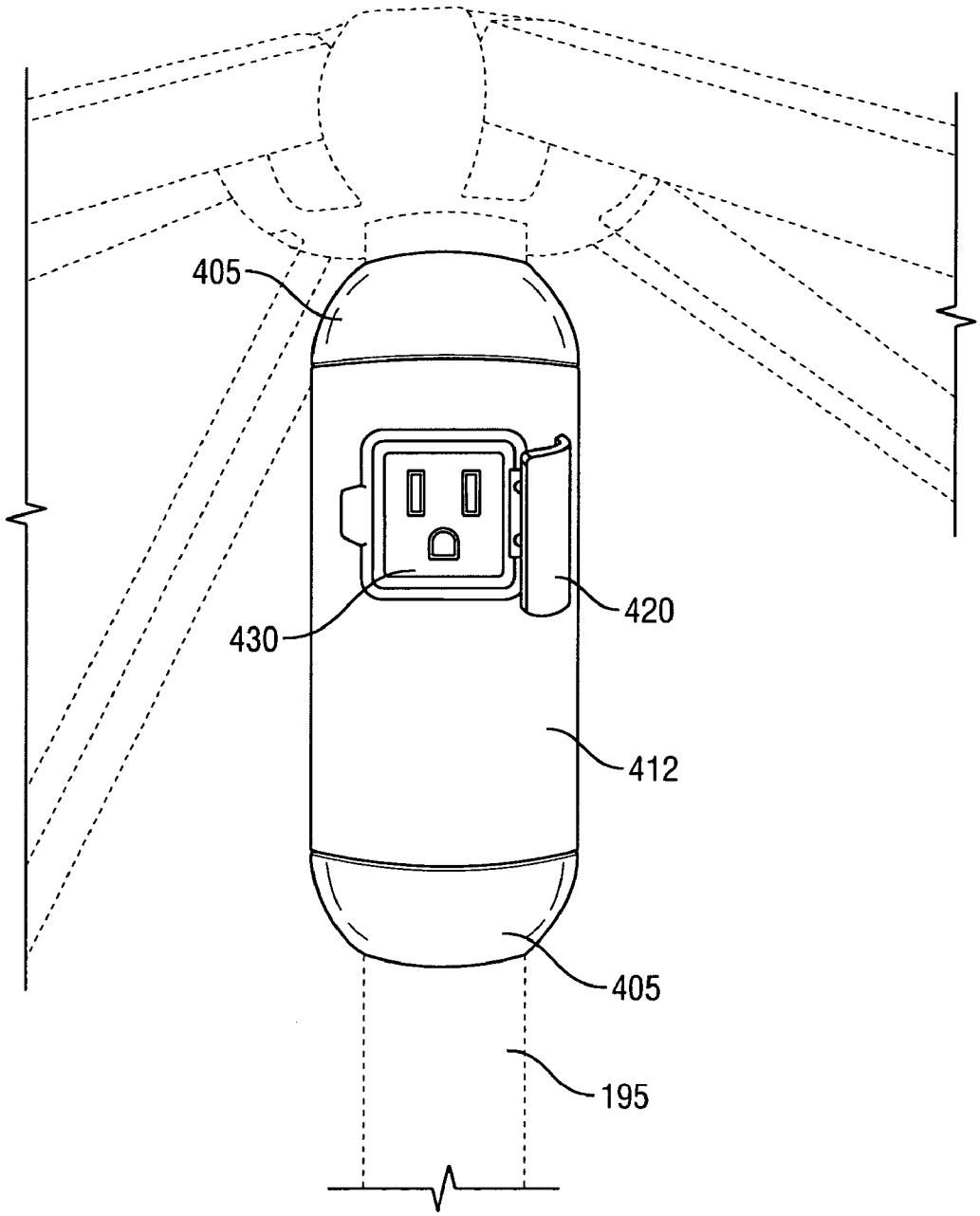
FIG. 13 illustrates the top power hub shown in FIG. 12 with an outlet cover in an open position in accordance with an embodiment of the present invention.
Figure 14:
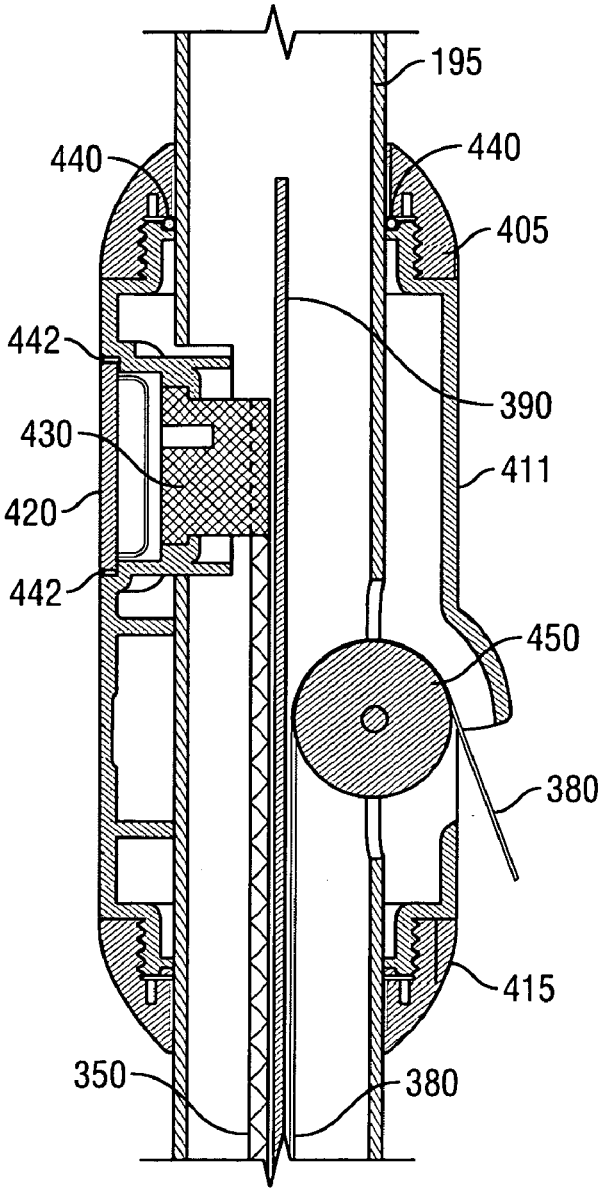
FIG. 14 illustrates a longitudinal cross-sectional view of the top power. hub shown in FIG. 12 in accordance with an embodiment of the present invention.
Figure 15:
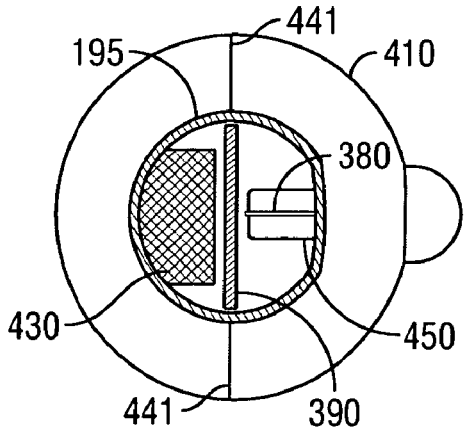
FIG. 15 illustrates a latitudinal cross-sectional view of the top tube slightly above the top power hub shown in FIG. 12 in accordance with an embodiment of the present invention.

FIGS. 12, 13, 14 and 15 illustrate a top power hub 410 in accordance with an embodiment of the present invention. As shown in FIGS. 12 and 13, the top power hub 410 includes top power hub end caps 405, a top power hub faceplate 412, a top outlet cover 420, and a top power outlet 430. As shown in the longitudinal cross-sectional view of FIG. 14 and the latitudinal cross-sectional view of FIG. 15, the top power hub 14 also includes a wire guide backplate 411, a top power hub end cap seal 440, top power hub plate seals 441, top power hub faceplate cover seals 442, and a wire guide 450.

The top power outlet 430 is connected to the top section internal power cable 350 trained inside the top tube 195 from the mid-level power outlet 330. The top power outlet 430 is positioned within openings in the sidewall of the top tube 195 and attached to the top power hub faceplate 412. The top outlet cover 420 is attached with a hinge to the top power hub faceplate 412. The top power hub end caps 405 encircle the outer surface of the top tube 195 and attach to the top power hub faceplate 412 and the wire guide backplate 411.

The wire guide 450 is located within a hole in the sidewall of the top tube 195. The wire guide 450 is attached to the sidewall of the top tube 195. Inside the top tube 195, the canopy crank wire 380 is trained from the crank bolt 166 shown in FIG. 11 to the wire guide 450. The canopy crank wire 380 and the wire guide 450 are separated from the top section internal power cable 350 by the internal separation device 390. The canopy crank wire 380 drapes over the wire guide 450 and exits the top power hub 410 through an opening in the wire guide backplate 411.

The top power hub faceplate 412 and the wire guide backplate 411 are positioned on opposite sides of the top tube 195 with opposing edges pressed together. Threads in the top power hub end caps 405 engage threads on the top power hub faceplate 312 and the wire guide backplate 411. The top power hub end caps 405 are rotated until tightly seated with the top power hub faceplate 312 and the wire guide backplate 411.

To prevent the intrusion of water, dust particles, and other undesired foreign objects into the top power hub 410, the top power hub 410 includes the top outlet cover 420, the top power hub end cap seal 440, the top power hub plate seals 441, and the top power hub faceplate cover seals 442. The top power hub end cap seal 440 is placed around the top tube 195 along the top of the top power hub faceplate 412 and the wire guide backplate 411. As the top power hub end caps 405 are threaded onto the top power hub faceplate 412 and the wire guide backplate 411, the top power hub end cap seal 440 is compressed between the top power hub end cap 405 and both the top power hub faceplate 412 and the wire guide backplate 411. Compressing the top power hub end cap seal 440 forces the top power hub end cap seal 440 against the outer surface of the top tube 195 and forms a watertight seal.

In addition to the top power hub end cap seal 440, the top power hub 410 includes the top power hub plate seals 441. The top power hub plate seals 441 are sandwiched between the shared edges of the top power hub faceplate 412 and the wire guide backplate 411. As the top power hub end caps 405 are threaded onto the top power hub faceplate 412 and the wire guide backplate 411, edges of the top power hub faceplate 412 and the wire guide backplate 411 are forced together and compress the top power hub plate seals 441 to form a watertight seal.

To cover the top power outlet 430 when not in use and reduce the intrusion of water and other particles, the top outlet cover 420 is provided. The top outlet cover 420 is positioned over the top power outlet 430. The top outlet cover 420 is attached to the top power hub faceplate 412 with a hinge. To insert a plug into the top power outlet 430, the top outlet cover 420 may be rotated into the open position as illustrated in FIG. 13. When a plug is removed from the top power outlet 430, the top outlet cover 420 is rotated into a closed position as illustrated in FIG. 12.

To assist in closing the top outlet cover 420, a cover-closing device 226 similar to that used in the bidirectional power hub 210 is attached to the top outlet cover 420. The cover-closing device 226 is anchored to the top power hub faceplate 412. The cover-closing device 226 exerts a force on the top outlet cover 420 that causes the top outlet cover 420 to rotate into the closed position.

To further prevent moisture, dirt, and other foreign objects from entering through gaps between the top power hub faceplate 412 and edges of the top outlet cover 420, top power hub faceplate cover seals 442 may be installed around the edges of the top outlet cover 420. With the top outlet cover 420 in the closed position, the top power hub faceplate cover seals 442 fill the gaps between the top power hub faceplate 412 and edges of the top outlet cover 420.

In an alternative embodiment, there may be a plurality of bottom power outlets 230, mid-level power outlets 330, and/or top power outlets 430. Also, there may be a plurality of bi-directional power hubs 210, mid-level power hubs 310, and/or top power hubs 410 spread throughout the length of the powered top pole section 140 and the powered bottom pole section 130. Also, the bottom power outlet 230, the mid-level power outlet 330, and the top power outlet 430 may be installed in power hubs that are separated from other components such as the input power receptacle 221, the umbrella crank handle 165, and the wire guide 450.

In an alternative embodiment, a ground fault circuit interrupter 110 similar to that shown in FIG. 1 may be installed in a power hub on the patio pole umbrella 100. For example, a ground fault circuit interrupter 110 may be installed in the bi-directional power hub 210, the mid-level power hub 310, or the top level power hub 410. The ground fault circuit interrupter 110 may be installed in the power hubs 210, 310, and 410 in place of or in addition to the ground fault circuit interrupter 110 installed in the power cord 115.

Figure 16:
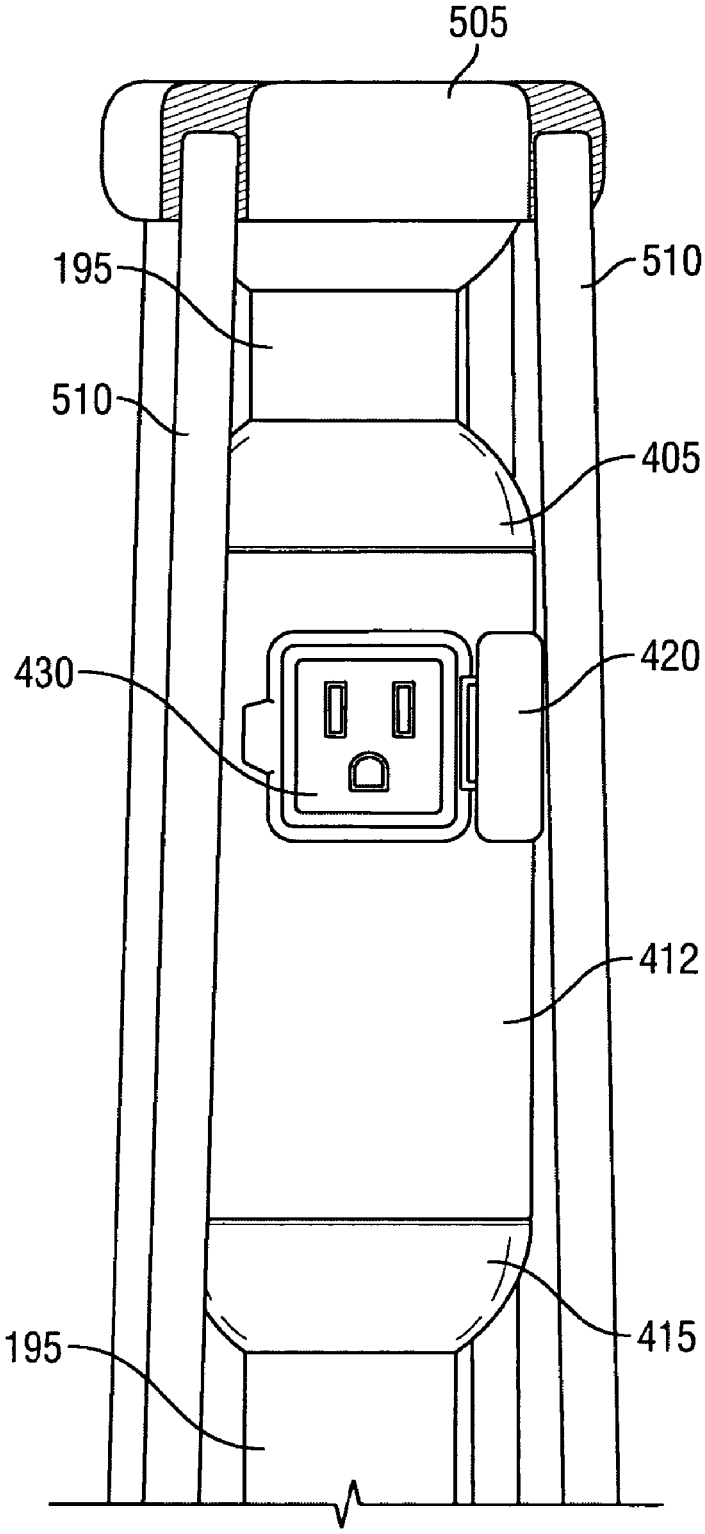
FIG. 16 illustrates the position of a support rib hub and support ribs in relation to the outlet cover of a power hub in accordance with an embodiment of the present invention.
Figure 17:
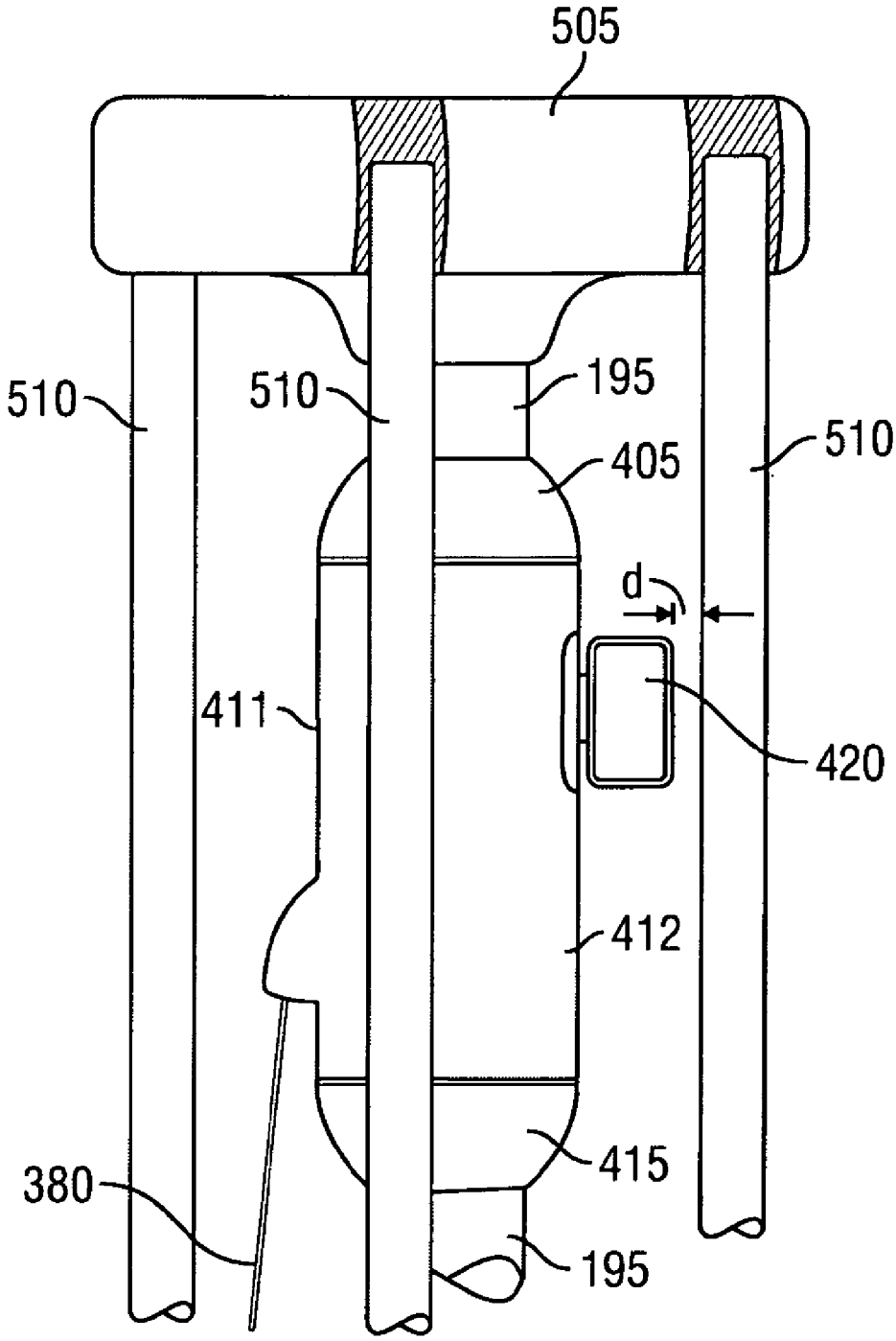
FIG. 17 illustrates the size of a power hub and position of support ribs in relation to the outlet cover of the power hub in accordance with an embodiment of the present invention.
Figure 18:
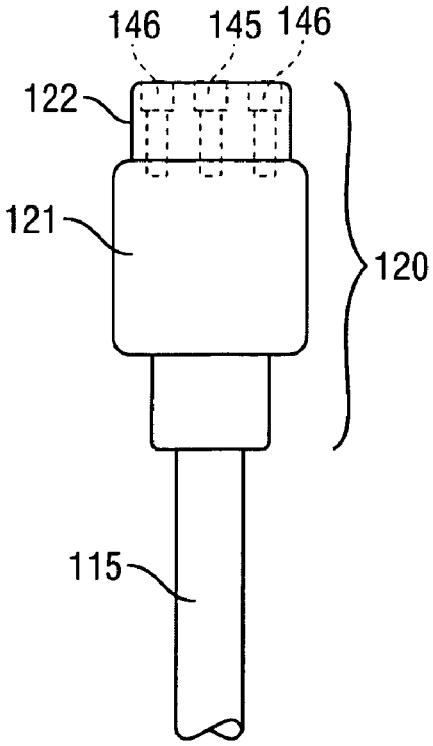
FIG. 18 illustrates a separable male input power connector in accordance with an embodiment of the present invention.
Figure 19:
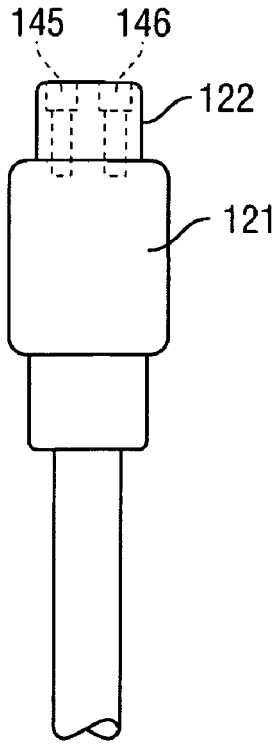
FIG. 19 illustrates a side view of the male input power connector shown in FIG. 18 in accordance with an embodiment of the present invention.
Figure 20:
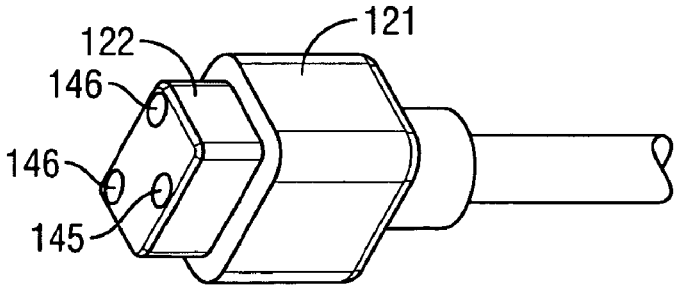
FIG. 20 illustrates a perspective view of the male input power connector shown in FIG. 18 in accordance with an embodiment of the present invention.
Figure 21:
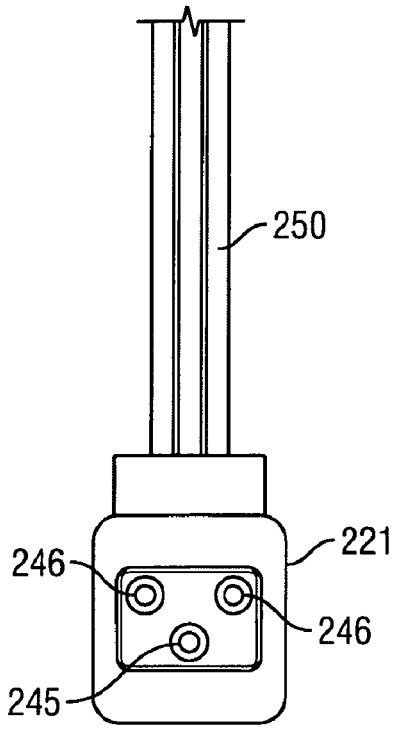
FIG. 21 illustrates a separable female input power connector in accordance with an embodiment of the present invention.
Figure 22:
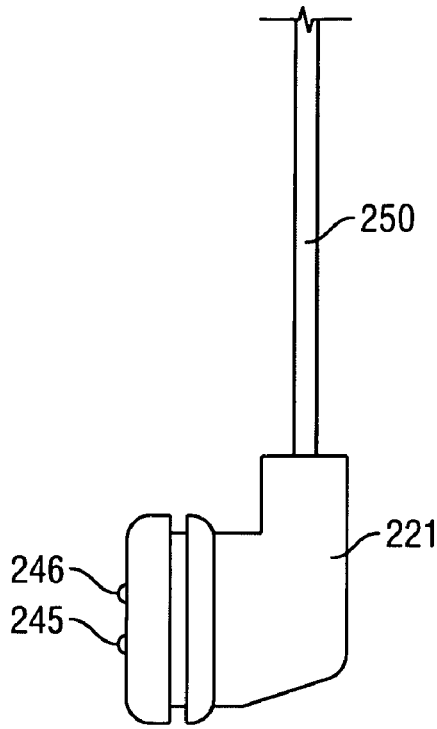
FIG. 22 illustrates a side view of the separable female input power connector shown in FIG. 21 in accordance with an embodiment of the present invention.
Figure 23:
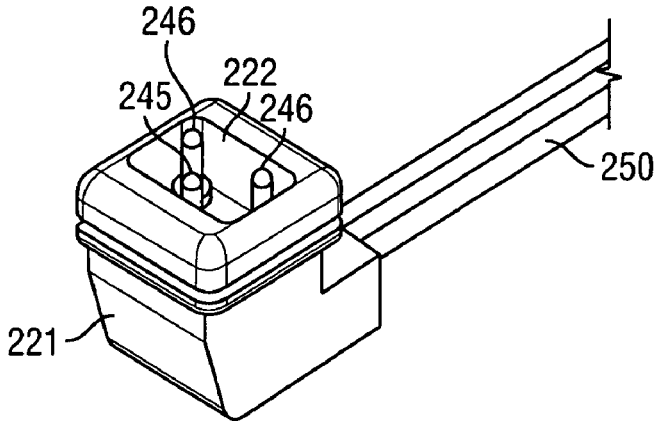
FIG. 23 illustrates a perspective view of the separable female input power connector shown in FIG. 21 in accordance with an embodiment of the present invention.
Figure 24:
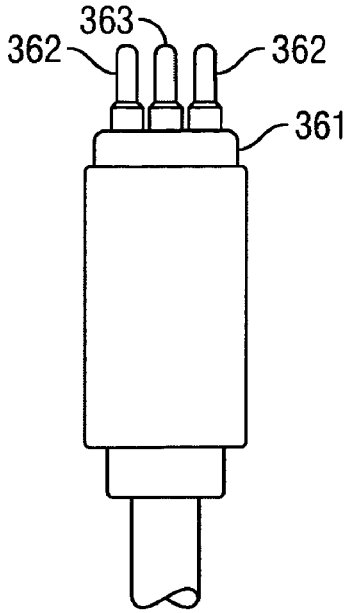
FIG. 24 illustrates a separable male internal power connector in accordance with an embodiment of the present invention.

FIGS. 16 and 17 illustrate the top power hub 410 shown in FIGS. 12–15 with a support rib hub 505 and support ribs 510 in accordance with an embodiment of the present invention. The support ribs 510 support the umbrella canopy 150. The support rib hub 505 is positioned on the end of the top tube 195. The support ribs 510 are connected to the support rib hub 505. The top outlet cover 420 and the top power outlet 430 are positioned between the support ribs 510 when the umbrella canopy 150 is in the closed position.

In operation, the umbrella crank handle 165 shown in FIGS. 1, 2 and 8–11 is rotated to open and close the umbrella canopy 150. As the umbrella canopy 150 is closed, the support ribs 510 that support the umbrella canopy 150 are drawn inward towards the powered top pole section 140 of the powered patio pole umbrella 100. As the support ribs 510 are drawn inward towards the powered top pole section 140, plugs of devices plugged into the top power hub 430, such as the lamp 20 shown in FIG. 2, may be damaged if the support ribs 510 crush or bend the plug. Similarly, the top outlet cover 420 may be damaged by the support ribs 510 when the umbrella canopy 150 is lowered.

To prevent damage to the top outlet cover 420 and plugs of devices that are plugged into the top power outlet 430 while the umbrella canopy 150 and the support ribs 510 are being lowered, the top power outlet 430 and the top outlet cover 420 may be positioned to avoid contact with the support ribs 510. For example, as shown in FIG. 16, the top power outlet 430 and the top outlet cover 420 may be positioned relative to the support ribs 510 such that the top outlet cover 420 and the top power outlet 430 are situated between the support ribs 510 and do not contact the support ribs 510 when the umbrella canopy 150 is opened and closed.

In the alternative, the size of the support rib hub 505 may be such that the support ribs 510 do not contact the top power outlet 430 or the top outlet cover 420 when the umbrella canopy 150 is opened or closed. For example, as shown in FIG. 17, the diameter of the support rib hub 505 may be such that the support ribs 510 never get closer than a predetermined minimum distance to an open top outlet cover 420. In FIG. 17, the top outlet cover 420 is in the open position and all of the support ribs 510 are prevented from getting closer than a minimum distance designated as "d" from the open top outlet cover 420.

Consequently, devices plugged into the top power outlet 430 may be conveniently left plugged in when the umbrella canopy 150 is lowered without incurring damage from the support ribs 510 or other portions of the support structure. 105 FIGS. 18, 19, 20, 21, 22, and 23 illustrate an embodiment of a power input connector 120 and an input power receptacle 221 in accordance with an embodiment of the present invention. The power input connector 120 includes a power input connector base 121, a power input connector face 122, female input power terminals 146, and a female input ground terminal 145. The input power receptacle 221 includes an input power receptacle cavity 222, a male input ground terminal 245, and male input power terminals 246.

The power input connector base 121 is connected to the power chord 115. The power input connector face 122 is connected to the power input connector base 121. The female power input terminals 146 are attached to conductors within the power chord 115 that carry electricity from the power outlet 106. The female power input terminals 146 are positioned inside the power input connector face 122. The female input ground terminal 145 is also positioned inside the power input connector face 122.

The input power receptacle 221 is connected to the bottom section internal power cable 250. The input power receptacle cavity 222 is located within the input power receptacle 221 and sized to receive the power input connector face 122 of the power input connector 120. The male input power terminals 246 are attached to conductors within the bottom section internal power cable 250. The male input power terminals 246 are positioned inside the input power receptacle cavity 222. The male input ground terminal 245 is also positioned within the input power receptacle cavity 222 and connected to a ground conductor within the bottom section internal power cable 250.

In operation, the power cord 115 provides electrical power to the powered patio pole umbrella 100 from an AC power source. For example, the outlet plug 105 on the end of power cord 115 is plugged into a power source 106 as shown in FIG. 2. The power input connector 120 is plugged into the input power receptacle 221 to provide a conductive path for power to flow from the power source 106 to the input power receptacle 221 of the powered patio pole umbrella 100.

As the power input connector 120 is plugged into the input power receptacle 221, the power input connector face 122 is inserted into the input power receptacle cavity 222. After the power input connector face 122 is inserted into the input power receptacle cavity 222, the male input power terminals 246 are seated within the female input power terminals 146. Similarly, the male input ground terminal 245 is seated within the female input ground terminal 145. Contact between the male input power terminals 246 and the female input power terminals 146 allows electricity to flow from the female input power terminals 146 to the male input power terminals 246. Contact between the male input ground terminal 245 and the female input ground terminal 145 furnishes a conductive path to an established ground for the powered patio pole umbrella 100.

FIGS. 24, 25, 26, 27, 28 and 29 illustrate the male internal power connector 360 and the female internal power connector 260 in accordance with an embodiment of the present invention. The male internal power connector 360 includes a male internal power connector face 361, male internal power connector terminals 362, and a male internal ground terminal 363. The female internal power connector 260 includes an internal power connector cavity 261, female internal power connector terminals 262, and female internal ground terminal 263.

The female internal power connector 260 is connected to the bottom section internal power cable 250. The internal power connector cavity 261 is located within the end of the female internal power connector 260. The female internal power connector 262 and the female internal ground terminal 263 are connected to conductors in the bottom section internal power cable 250. The female internal power connector terminals 262 and the female internal ground terminal 263 are located on the bottom surface of the internal power cavity 261.

The male internal power connector 360 is connected to the top section internal power cable 350. The male internal power connector terminals 362 and the male internal ground terminal 363 are connected to conductors in the top section internal power cable 350. The male internal power connector terminals 362 and the male internal ground terminal 363 are located on the male internal power connector face 361 of the male internal power connector 360.

In operation, the male internal power connector 360 is plugged into the female internal power connector 260. The connection between the female internal power connector 260 and the male internal power connector 360 provides a conductive path for power to be transferred between the bottom section internal power cable 250 and the top section internal power cable 350.

As the male internal power connector 360 is plugged into the female internal power connector 260, the male internal power connector face 361 is inserted into the internal power connector cavity 261. After the male internal power connector face 361 is inserted into the internal power connector cavity 261, the male internal power connector terminals 362 are seated within the female internal power connector terminals 262. Similarly, the male internal ground terminal 363 is seated within the female internal ground terminal 263. Contact between the male internal power connector terminals 362 and the female internal power connector terminals 262 allows electricity to flow from the female internal power connector terminals 262 to the male internal power connector terminals 362. Contact between the male internal ground terminal 363 and the female internal ground terminal 263 furnishes a conductive path to an established ground for the powered top section 140 of the powered patio pole umbrella 100.

As shown in FIGS. 24–29, the relative positions of the male internal power connector terminals 362, the male internal ground terminal 363, the female internal power connector terminals 262, and the female ground terminal 263 are such that the male internal power connector 360 is prevented from plugging into the female internal power connector 260 unless corresponding power terminals and ground terminals are properly aligned.

Figure 25:
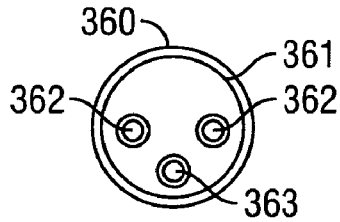
FIG. 25 illustrates an end view of the male internal power connector shown in FIG. 24 in accordance with an embodiment of the present invention.
Figure 26:
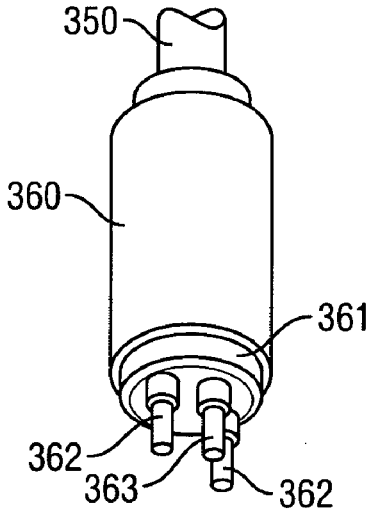
FIG. 26 illustrates a perspective view of the male internal power connector shown in FIG. 24 in accordance with an embodiment of the present invention.
Figure 27:
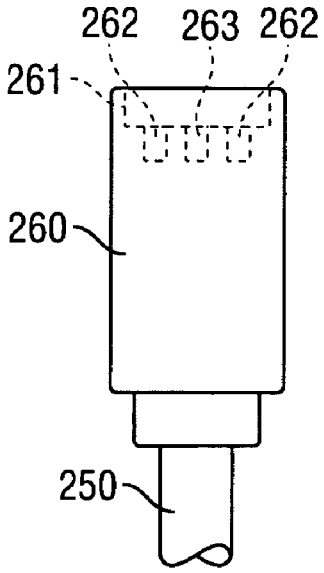
FIG. 27 illustrates a separable female internal power connector in accordance with an embodiment of the present invention.
Figure 28:
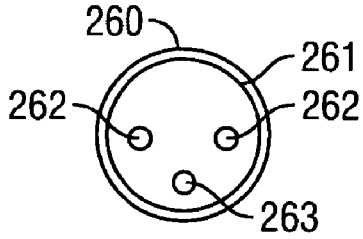
FIG. 28 illustrates an end view of the female internal power connector shown in FIG. 27 in accordance with an embodiment of the present invention.
Figure 29:
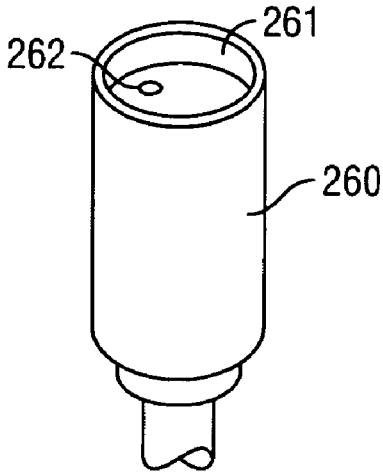
FIG. 29 illustrates a perspective view of the female internal power connector shown in FIG. 27 in accordance with an embodiment of the present invention.

For example, the male internal power connector terminals 362 in FIG. 25 are positioned on opposite sides of the periphery of the male internal power connector 360. The male internal ground terminal 363 is positioned along the periphery of male internal power connector 360 perpendicular to an axis running through both of the male internal power connector terminals 362. Likewise, the female internal power connector terminals 262 in FIG. 28 are positioned on opposite sides of the periphery of female internal power connector 260. The female internal ground terminal 263 is positioned along the periphery of female internal power connector 260 perpendicular to an axis running through both of the female internal power connector terminals 262. With the male internal power connector terminals 362, the female internal power connector terminals 262, the male internal ground terminal 363, and the female internal ground terminal 263 in this configuration, the male internal power connector 360 is prevented from being inserted into the female internal power connector 260 unless the terminals are properly aligned.

In alternative embodiments, the male internal power connector terminals 362, the female internal power connector terminals 262, the male internal ground terminal 363, and the female internal ground terminal 263 may be positioned in a different configuration. For example, the male internal power connector terminals 362 and the male internal ground terminal 363 may be positioned along a single axis running across the face of the male internal power connector 360 with the male internal ground terminal 363 located between the two male internal power connector terminals 362. Likewise, the female internal power connector terminals 262 and the female internal ground terminal 263 could be similarly positioned to received corresponding male internal power connector terminals 362 and the male internal ground terminal 363.

In another alternative embodiment, the locations of the male internal power connector 360 and the female internal power connector 260 may be switched. The male internal power connector 360 may attached to the bottom section internal power cable 250 and the female internal power connector 260 may be attached to the top section internal power cable 350.

Figure 30:
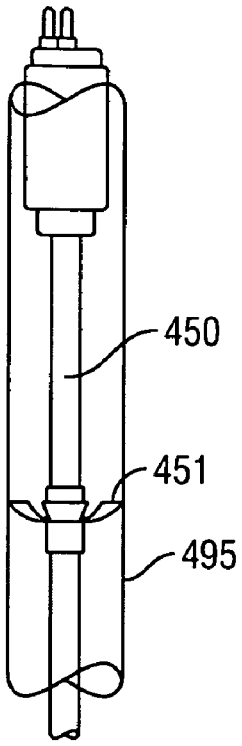
FIG. 30 illustrates a power cable restraint in accordance with an embodiment of the present invention.
Figure 31:
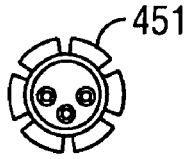
FIG. 31 illustrates an end view of an internal power cable with a separable male internal power connector and the power cable restraint shown in FIG. 30 in accordance with an embodiment of the present invention.

FIGS. 30 and 31 illustrate a power cable restraint 451 in accordance with an embodiment of the present invention. The power cable restraint 451 is attached to a power cable 450. The power cable 450 and the power cable restraint 451 are inserted inside a tube 495.

In operation, the power cable restraint 451 contacts the inner surface of the tube 495. Lateral movement of the power cable 450 inside the tube 495 is prevented by the contact between the power cable restraint 451 and the inner surface of the tube 495. Longitudinal movement of the power cable 450 inside the tube 495 is prevented by friction between the edges of the power cable restraint 451 and the inner surface of the tube 495. Consequently, the power cable 450 is prevented from shifting around inside the tube 495.

Because the power cable restraint 451 prevents the power cable 450 from shifting around inside the tube 495, the power cable restraint 451 may be used inside the bottom tube 190 and top tube 195 of the powered patio pole umbrella 100 to prevent the bottom section internal power cable 250 and top section internal power cable 350 from sliding and shifting inside the bottom tube 190 and the top tube 195. By preventing the bottom section internal power cable 250 and the top section internal power cable 350 from sliding and shifting, the male internal power connector 360 and the female internal power connector 260 may be prevented from sliding into the bottom tube 190 and the top tube 195 and making the male internal power connector 360 and the female internal power connector 260 unreachable. Also, restraining movement of the bottom section internal power cable 250 and the top section internal power cable 350 with the power cable restraint 451 assists in maintaining predetermined spacing between both the bottom section internal power cable 250 and the top section internal power cable 350 and other components inside the bottom tube 190 and the top tube 195 of the powered patio pole umbrella 100.

Figure 32:
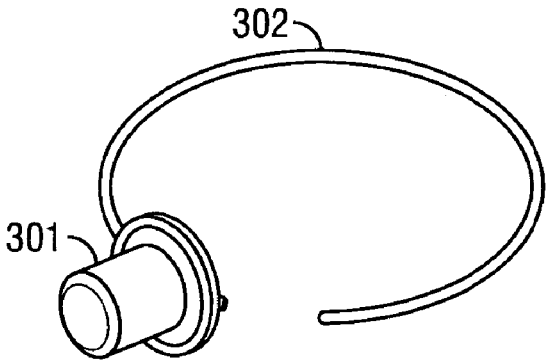
FIG. 32 illustrates a pole section slip restraint in accordance with an embodiment of the present invention.

FIG. 32 illustrates a pole section slip restraint 301 in accordance with an embodiment of the present invention. The pole section slip restraint 301 is attached to a pole section slip restraint ring 302.

In operation, the pole section slip restraint 301 and the pole section slip restraint ring 302 are positioned inside the pole connection piece 185 of the powered top pole section 140 as shown in FIG. 11. The pole section slip restraint ring 302 is installed inside the pole connection piece 185 with the top section internal power cable 360 trained through the opening of the pole section slip restraint ring 302. The pole section slip restraint 301 is inserted in a hole in the sidewall of the pole connection piece 185.

As described above with respect to FIG. 1, the pole section slip restraint 301 depresses into the pole connection piece 185 of the powered top pole section 140. With the pole section slip restraint 301 depressed, the pole connection piece 185 slides into the pole connection aperture 131 of the powered bottom pole section 130. The pole connection piece 185 is positioned within the pole connection aperture 131 such that the pole section slip restraint 301 aligns with a hole in a sidewall of the bottom tube 190. The hole in the sidewall of the bottom tube 190 is sized to receive the pole section slip restraint 301 as the pole section slip restraint 301 is forced into the hole by pressure supplied by the pole section slip restrain ring 302. Engagement of the pole section slip restraint 301 with the hole in the sidewall of bottom tube 190 prevents rotation and sliding of the top tube 195 with respect to the bottom tube 190.

Consequently, the pole section slip restraint 301 prevents damage to the bottom section internal power cable 250 and the top section internal power cable 350 that would result from twisting if the top tube 195 was allowed to rotate with respect to the bottom tube 190. Also, the pole section slip restraint ring 302 provides a force that keeps the pole section slip restraint 301 positioned within the hole in the sidewall of the bottom tube 190 while also accommodating the bottom section internal power cable 250 and the top section internal power cable 350 that are trained inside the bottom tube 190 and the top tube 195.

Thus, the powered patio pole umbrella 100 provides a safer wire management system for providing electrical power to devices used outdoors without impairing the overall operability of a patio pole umbrella.

That is, rather than extending numerous extension cords across a yard or patio and/or positioning power strips around an umbrella, a consumer may safely and conveniently plug electrical devices into power outlets provided by the powered patio pole umbrella 100. To reduce the risks of shock or other hazards associated with using electricity in an outdoor environment, the powered patio pole umbrella 100 includes numerous safety features.

For example, incidental contact with power cords is reduced by routing a single power cord from a power outlet to a powered patio pole umbrella 100. While an input power receptacle 221 may be positioned in the support base 125 for the powered patio pole umbrella 100, the input power receptacle 221 is positioned in the powered bottom pole section 130 of the powered patio pole umbrella 100 to raise the location of the input power receptacle 221 above the level of the ground. By positioning the input power receptacle 221 further from the ground, exposure of the input power receptacle 221 to moisture and contaminants at the ground level is reduced.

To further reduce exposure of electrified components to moisture and contaminants, the power patio pole umbrella 100 has been provided with various water seals and protective covers. For example, the power hubs 210, 310, and 410 have been provided with cap seals 240, 340, and 440 to prevent moisture and particles from leaking into the power hubs 210, 310, and 410. Also, the power hubs 210, 310, and 410 have been provided with outlet covers 220, 320, and 420 along with cover seals 242, 342, and 442 to prevent the entrance of moisture and particles into the power outlets 230, 330, and 430 and other parts of the power hubs 210, 310, and 410.

Alternatively, the power hubs 210, 310, and 410 may be equipped with a drain in the lower cap seal 240, 340, 440, to allow the exit of moisture under the force of gravity. Also, the outlet covers 220, 320, and 420 may include a drain at the bottom of the outlet cover to allow the drainage of water under the force of gravity.

In addition to the ground fault circuit interrupter 110 shown near the outlet 106, a ground fault circuit interrupter 110 similar to that shown in FIG. 1 may be installed in a power hub on the patio pole umbrella 100. For example, a ground fault circuit interrupter 110 may be installed in the bi-directional power hub 210, the mid-level power hub 310, or the top level power hub 410. The ground fault circuit interrupter 110 may be installed in the power hubs 210, 310, and 410 in place of or in addition to the ground fault circuit interrupter 110 installed in the power cord 115.

The power hubs 210, 310, and 410 have also been incorporated into the powered patio pole umbrella 100 without impairing the operability of the powered patio pole umbrella 100.

For example, an umbrella crank handle 165 is included with the powered patio pole umbrella 100 for raising and lowering the umbrella canopy 150. The umbrella canopy 150 may be raised and lowered without damaging electrical components within the powered patio pole umbrella 100 or having to unplug devices plugged into the powered patio pole umbrella 100.

To protect power cables 250, 350 and other electrical components within the powered patio pole umbrella 100, the moving parts associated with raising and lowering the umbrella canopy 150 are separated from the electrical components by an internal separation device 390. The internal separation device 390 prevents the power cables 250, 350 and other electrical components from contacting the moving parts and being damaged due to abrasive and corrosive effects. Thus, by separating the power cables 250, 350 and other electrical components from the moving parts, there is less chance for conductors within the power cables 250, 350 and other components to become exposed and accidentally electrify unintended portions of the powered patio pole umbrella 100.

Additionally, some portions of the powered patio pole umbrella 100 and some devices on the powered patio pole umbrella 100 are protected from damage by predetermined positioning or sizing of portions of the umbrella canopy support structure. For example, the power hubs 210, 310, and 410 may be aligned with gaps between the canopy support ribs 510 or other portions of the canopy support structure. Also, the canopy support rib hub 505 may be increased in size and/or portions of the canopy support structure may be bent in order to prevent contact between the canopy support structure and portions of the power hubs 210, 310, and 410 such as the outlet covers 220, 320, and 420.

Additionally, the central pole of the powered patio pole umbrella 100 including the powered bottom pole section 130 and the powered top pole section 140 may be composed of a pole having a greater diameter than the pole depicted in FIGS. 1 and 2. For example, the powered bottom pole section 130 and the powered top pole section 140 include hub areas having a greater diameter than other areas along the pole as shown in FIGS. 1 and 2. Alternatively, the diameter of the powered bottom pole section 130 and the powered top pole section 140 may be made to equal the diameter of the hub section and maintain that diameter the length of the pole. The overall effect of the change in pole diameter may be to decrease the appearance of the electrical outlets while at the same time providing better moisture proofing. That is, the hubs are eliminated and consequently the hub seals at top and bottom need not be relied upon.

Thus, the powered patio pole umbrella 100 provides safety and convenience not provided by prior art patio pole umbrellas. A consumer may easily assemble a powered patio pole umbrella 100 and plug the powered patio pole umbrella 100 into an outlet 106. Electrical devices may be conveniently plugged into the power outlets 230, 330, and 430 provided by the powered patio pole umbrella 100 without a need for long extension cords. Also, precious usable space is freed up by plugging cords into power outlets 230, 330, and 430 on the pole rather than hazardously draping and hanging cords on and above a patio table 107.

When a consumer is done using the powered patio pole umbrella 100, the inconvenience of having to unplug lights and put away extension cords is eliminated. The powered patio pole umbrella 100 is moisture resistant and may be safely left connected to a power source 106. Similarly, lights may be left plugged into the top outlet 430 even if the umbrella canopy 150 is lowered because clearance is provided between the top outlet 430 and the canopy support structure so that plugs and outlet covers will not be damaged.

Thus, a powered patio pole umbrella 100 provides a safe and convenient wire management system that frees up usable space under the powered patio pole umbrella 100 and reduces clutter associated with power cords of electrical devices. The powered patio pole umbrella 100 also provides flexibility as to what types of devices may be supplied with power. The powered patio pole umbrella 100 also provides a system where devices powered by the powered patio pole umbrella 100 may be easily swapped and changed.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A patio pole umbrella including:

an umbrella canopy;

a pole for supporting said umbrella canopy; and a power hub affixed to said pole, wherein said power hub includes an electrical outlet supplying AC electricity to an electrical device wherein said hub includes an input power receptacle receiving AC electricity.

2. The patio pole umbrella of claim 1 wherein an electrical connector is introduced into said input power receptacle to provide electrical power to said electrical outlet.

3. The patio pole umbrella of claim 2 wherein said electrical connector is removable from said input power receptacle.

4. The patio pole umbrella of claim 2 wherein said electrical connector is connected to an electrical cord including a circuit interrupter.

5. The patio pole umbrella of claim 4 wherein said circuit interrupter is a ground fault circuit interrupter.

6. The patio pole umbrella of claim 1 wherein said pole is supported by a base resting on a surface and said power hub is positioned vertically upward from said surface along said pole.

7. The patio pole umbrella of claim 1 wherein said pole is not permanently fixed in a single location.

8. The patio pole umbrella of claim 1 wherein said electrical outlet is at least partially coverable by a movable door attached to said power hub.

9. The patio pole umbrella of claim 1 further including at least one additional electrical outlet for providing AC electricity to an electrical device;

wherein said additional electrical outlet is positioned at a different vertical height along said pole from said power hub.

10. The patio pole umbrella of claim 1 wherein said pole comprises more than one vertical section.

11. The patio pole umbrella of claim 10 wherein at least two of said vertical sections include an additional electrical outlet for providing AC electricity to an electrical device.

12. The patio pole umbrella of claim 11 wherein an internal electrical connection is provided between said at least two vertical sections to provide power to said additional electrical outlets.

13. The patio pole umbrella of claim 12 wherein said internal electrical connection is comprised of a plurality of electrical connectors that are physically connected to provide electrical power to said additional electrical outlets.

14. The patio pole umbrella of claim 10 wherein said pole includes an internal separator to axially separate the interior of said pole into at least two sections.

15. The patio pole umbrella of claim 14 wherein electrical current carrying elements are placed in one of said sections to isolate said electrical current carrying elements from the remainder of the interior of the pole.

16. A movable outdoor furniture article including:

a pole for supporting a canopy of an umbrella; and a power hub;

wherein said power hub is incorporated into said pole; and wherein said power hub includes an electrical outlet providing AC electricity to an electrical device; and an input power receptacle receiving electrical power;

wherein an electrical connector is introduced into said input power receptacle to provide electrical power to said electrical outlet.

17. The movable outdoor furniture article of claim 16 wherein said electrical connector is removable from said input power receptacle.

18. The movable outdoor furniture article of claim 16 wherein said electrical connector is connected to an electrical cord including a circuit interrupter.

19. The movable outdoor furniture article of claim 18 wherein said circuit interrupter is a ground fault circuit interrupter.

20. The movable outdoor furniture article of claim 16 wherein said pole is supported by a base resting on a surface and said power hub is positioned vertically upward from said surface.

21. The movable outdoor furniture article of claim 16 wherein said movable outdoor furniture article is not permanently fixed in a single location.

22. The movable outdoor furniture article of claim 16 wherein said electrical outlet is at least partially coverable by a movable door attached to said power hub.

23. The movable outdoor furniture article of claim 16 wherein said input power receptacle is at least partially coverable by a movable door attached to said power hub.

24. The movable outdoor furniture article of claim 16 further including at least one additional electrical outlet for providing AC electricity to an electrical device;

wherein said additional electrical outlet is positioned at a different vertical height along said pole from said power hub.

25. The movable outdoor furniture article of claim 16 wherein said pole comprises more than one section.

26. The movable outdoor furniture article of claim 25 wherein at least one of said sections includes an additional electrical outlet for providing AC electrical power to an electrical device.

27. The movable outdoor furniture article of claim 25 wherein at least two of said sections include an additional electrical outlet for providing AC electricity to an electrical device.

28. The movable outdoor furniture article of claim 27 wherein an internal electrical connection is provided between said at least two sections to provide power to said additional electrical outlets.

29. The movable outdoor furniture article of claim 28 wherein said internal electrical connection is comprised of a plurality of electrical connectors that are physically connected to provide electrical power to said additional electrical outlets.

* * * * *